US006213703B1

(12) United States Patent
Garrido

(10) Patent No.: US 6,213,703 B1
(45) **Date of Patent: *Apr. 10, 2001**

(54) ELECTRONIC BOOKSTORE VENDING MACHINE

(75) Inventor: Victor Manuel Celorio Garrido, Gainesville, FL (US)

(73) Assignee: Instabook Corporation, Gainesville, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/559,500

(22) Filed: Apr. 27, 2000

Related U.S. Application Data

(63) Continuation-in-part of application No. 09/353,006, filed on Jul. 13, 1999, now abandoned, which is a continuation-in-part of application No. 08/943,175, filed on Oct. 3, 1997, now Pat. No. 6,012,890.

(60) Provisional application No. 60/130,993, filed on Apr. 23, 1999, and provisional application No. 60/028,068, filed on Oct. 4, 1996.

(30) Foreign Application Priority Data

Sep. 29, 1998 (WO) ..... PCT/US9820421

(51) Int. Cl.[7] ..... B41F 13/54; B42C 19/00

(52) U.S. Cl. ..... 412/19; 270/1.02; 270/1.03; 270/21.1; 412/4; 412/8; 412/16; 412/32

(58) Field of Search ..... 270/1.02, 1.03, 270/21.1; 412/4, 8, 16, 19, 32

(56) References Cited

U.S. PATENT DOCUMENTS

| | | | | |
|---|---|---|---|---|
| 3,093,396 | * | 6/1963 | Segreto | 281/21.1 |
| 3,982,744 | * | 9/1976 | Kraynak et al. | 270/12 |
| 4,528,643 | | 7/1985 | Freeney, Jr. . | |
| 4,839,829 | * | 6/1989 | Freedman | 364/519 |
| 5,213,461 | * | 5/1993 | Kalisher | 412/4 |
| 5,240,362 | * | 8/1993 | Nakayama et al. | 412/11 |
| 5,465,213 | | 11/1995 | Ross . | |
| 5,547,176 | | 8/1996 | Williams et al. . | |
| 6,012,890 | * | 1/2000 | Garrido | 412/19 |

* cited by examiner

*Primary Examiner*—A. L. Wellington
*Assistant Examiner*—Mark T. Henderson
(74) *Attorney, Agent, or Firm*—Saliwanchik, Lloyd & Saliwanchik

(57) ABSTRACT

The present invention provides a method and system for producing books on-demand. An electronic bookstore in accordance with the subject invention can receive an electronic text file of a book and then print and bind a copy of the book. A user may browse an electronic catalog, for example over the Internet, and place an order for a book which can be picked up at a conveniently located electronic bookstore shortly after placing the order. The subject invention reduces costs and waste associated with conventional production and distribution of print matter. Advantageously, the subject invention allows books with smaller audiences to be published at a reasonable price. An electronic bookstore in accordance with the subject invention can have access to literally millions of books and can print and bind any selected book in a few minutes.

19 Claims, 26 Drawing Sheets

ELECTRONIC BOOKSTORE VENDING MACHINE

CROSS-REFERENCE TO A RELATED APPLICATION

This application claims priority to a continuation-in-part application Ser. No. 09/353,006, filed Jul. 13, 1999, now abandoned, which claims priority to provisional patent application Serial No. 60/130,993, filed Apr. 23, 1999, and claims priority to PCT application Serial No. PCT/US98/20421, filed Sep. 29, 1998, which designates the United States and which is a continuation-in-part of application Ser. No. 08/943,175, filed Oct. 3, 1997 (now U.S. Pat. No. 6,012,890, issued Jan. 11, 2000), which claims priority to provisional application Serial No. 60/028,068, filed Oct. 4, 1996.

BACKGROUND OF THE INVENTION

Books were among the firsts articles to be mass produced. The Gutenberg printing press was replaced by the lithography process, and then by offset printing. The goal of these processes and machines was to produce larger runs of, for example, books, magazines, and newspapers. The idea of large runs was central to the way the market developed in the western world: it was imperative to produce large quantities of a single item, so it could be created cheaply enough so as to be distributed all over the world and then sold locally. Mass production was the only way of achieving the goals of low cost, and accessibility through general distribution.

Recent discoveries, however, give us now the possibility of achieving the goals of lower cost and accessibility through a new process which does not involve mass production. Due to the advances in electronic processing of texts, a person can have access to books, magazines, and newspapers, written and edited at a distant location, distributed not by means of paper, but electronically. This new-found capability has prompted many people to suggest that we can do away with paper altogether, and handle all our texts electronically. This has lead to the development of many forms of electronic text processors. However, with respect to books, it is not practical because very few people like to read, for example a 600 page book, on a computer screen. For example, millions of people recently bought paper printed copies of such a book, namely, Sophie's World.

A method of distributing and manufacturing music on cassette tapes is disclosed in U.S. Pat. No. 4,528,643 Freeny Jr. Although Freeny Jr. discloses the method for distribution and reproduction of music at a remote location, it does not disclose the apparatus needed to distribute and reproduce books. In addition, Freeny Jr. does not disclose transmitting the music to a remote location in real time in response to a customer's order. In contrast, the Freeny Jr. disclosure requires an information manufacturing machine to electronically store all of the songs a consumer may select at the point of sale location. Accordingly, the selection is limited by the storage capacity of each information manufacturing unit.

The traditional method of producing and distributing books is wasteful. The traditional system requires the publishing industry to print millions of books, newspapers and/or magazines and then, after the books are produced, seek to sell them. Consequently, very large numbers of those books, newspaper, and magazines go to waste when they are not sold. This waste affects the price of the finished product and, therefore, the consumer must pay for this waste. In addition, the environment is being damaged by this activity.

Typical book binding machines are constructed to satisfy the needs of the publishing industry to produce larger and faster runs. The typical large capacity automatic book-binding systems are very expensive since several machines are required to print and bind a book, for example, an offset (or lithograph) printer, a transportation device for the paper, a paper sheet lifter, a web or collating machine, a folding machine and a thermal binder. To print a book, a very old technique called signature is often used, in which many pages (front and back) of a book are distributed on a large sheet of paper. Each signature holds many pages of the book, half of them head up and half of them head down so that when the large sheet of paper is folded the book pages match. After printing all of the signatures, the signatures are moved along a web, folded, glued and/or sewn. The book receives the cover and it is finally cut on three sides by a paper cutter.

These traditional systems work fine with the large runs of books, however, these systems do not work well with short runs of books which may be sporadic. U.S. Pat. No. 5,465,213 discloses an method to make single copies of books. However, the method disclosed in U.S. Pat. No. 5,465,213 requires an enormous capacity of digital storage due to the fact that their method uses a raster image (a copy) of the pages of a book. This raster image is acquired by copying a book which has already been printed, for example in the traditional way. As is well known, a raster image (bit-map) is akin to a photograph. These images are then stored in high-capacity optical disks, and the enormous size of an electronic file of the rasterized (scanned) book allows their system to store only a few dozen books per optical disk. Although U.S. Pat. No. 5,465,213 mentions the distribution of update information, for example for the index, through a modem, such large electronic files would also require large amounts of transmission bandwidth and time and, therefore, would require a great deal of time to be printed. U.S. Pat. No. 5,465,213 does not disclose the transmission of the raster images from a remote location in real time, for example in response to a customer's order. Furthermore, the method disclosed by U.S. Pat. No. 5,465,213 only allows searches of the index and/or description of the book. This is a severe limitation since the contents of the books cannot be searched. The main drawback of the disclosure of U.S. Pat. No. 5,465,213, however, is that a physical description of a unique apparatus for the binding and the delivery of the books is not disclosed. It discloses the use of commercially available binding machines which may or not work with the proposed system. In addition, the disclosed binding method uses thermal binding, which can release fumes that can be harmful to living beings. Accordingly, addressing the fumes released during thermal binding can be expensive. Most importantly, the disclosure of U.S. Pat. No. 5,465,213 concerns the reproduction of books which have already been printed and, therefore, does not avoid the necessity of an original printing of the books by the traditional methods.

U.S. Pat. No. 5,547,176, provides for an apparatus to copy (scan) a book and print the scanned images onto loose pages, and a method to bind those loose pages together by means of folding the sheets into semi-signatures and holding them together with a metal clasp. The disclosure of U.S. Pat. No. 5,547,176 requires the scanning of pages of a book already printed and creates images stored in inflexible bitmapped graphics. In addition, the binding process requires a metal clasp to hold the signatures together, making it uneconomical.

BRIEF SUMMARY OF THE INVENTION

The present invention provides a method and system for producing books on-demand; it can reduce the costs and improves the way books, magazines and other printer matters are created and delivered to the customer, helping to preserve both the environment and human health. The subject invention pertains to an electronic bookstore (EBS) vending machine which can receive an electronic text file of the contents for a book and then print and bind a copy of such a book. The electronic text file can be requested by communication with a central distribution unit (CDU) which can have the electronic text files stored and/or can access the electronic text files at, for example, a plurality of publisher's and/or author's storage facilities. The CDU, upon receiving a request for a certain book, can access and transmit the electronic text file to an appropriate EBS. Alternatively, the EBS can receive the electronic text file by any other available means, for example, floppy disks, optical disks, magnetic storage devices, via a modem, or from another computer. Once the EBS receives the electronic text file, the book can be printed and bound at the EBS.

The subject electronic bookstore vending machine pertains to a method, apparatus, and system, which when assembled together, allow the local printing, binding, and selling of a book, magazine, newspaper, or other printed matter in just a matter of minutes, and for a fraction of what it costs using traditional means. Using this system, each Electronic Bookstore can have access to millions of titles all of the time, day or night, without ever running out of them or having titles out of print. The method described in the present invention is flexible; it can allow complete searches of a book's contents and allow the reformatting of the size and type of fonts to accommodate the needs of visually challenged people. For example, the present method can allow for large type formatting and printing on demand.

The present invention ameliorates the problem of waste by allowing the delivery of printed matter on-demand, any time, any place, therefore, reducing the waste inherited in excessively large runs of books and magazines.

Another benefit of the present invention is to allow many more authors to publish their books in an economical fashion. Today, the publishing industry is affected by the ever rising costs of printing ever larger runs, therefore making it almost impossible for non-commercial writers to publish their works. Vast amounts of knowledge are lost when authors are not capable of publishing their books due to a small predicted audience or market. Certain types of books are more difficult to sell. Therefore, authors in subjects such as poetry, philosophy, science, and theater can find it difficult to publish their work due to the high investment required to print the books in the conventional manner.

The present invention can utilize the Internet as a way of distribution, in order to provide on-demand delivery. Writers can become their own publisher, for example, if their works are rejected through the convention publishing channels. Authors can make their works available to a wider audience. The present invention can also reduce the overall costs of producing books. Accordingly, the subject invention can increase the accessibility of knowledge, both in time and in price.

DETAILED DISCLOSURE OF THE INVENTION

Figure 1:
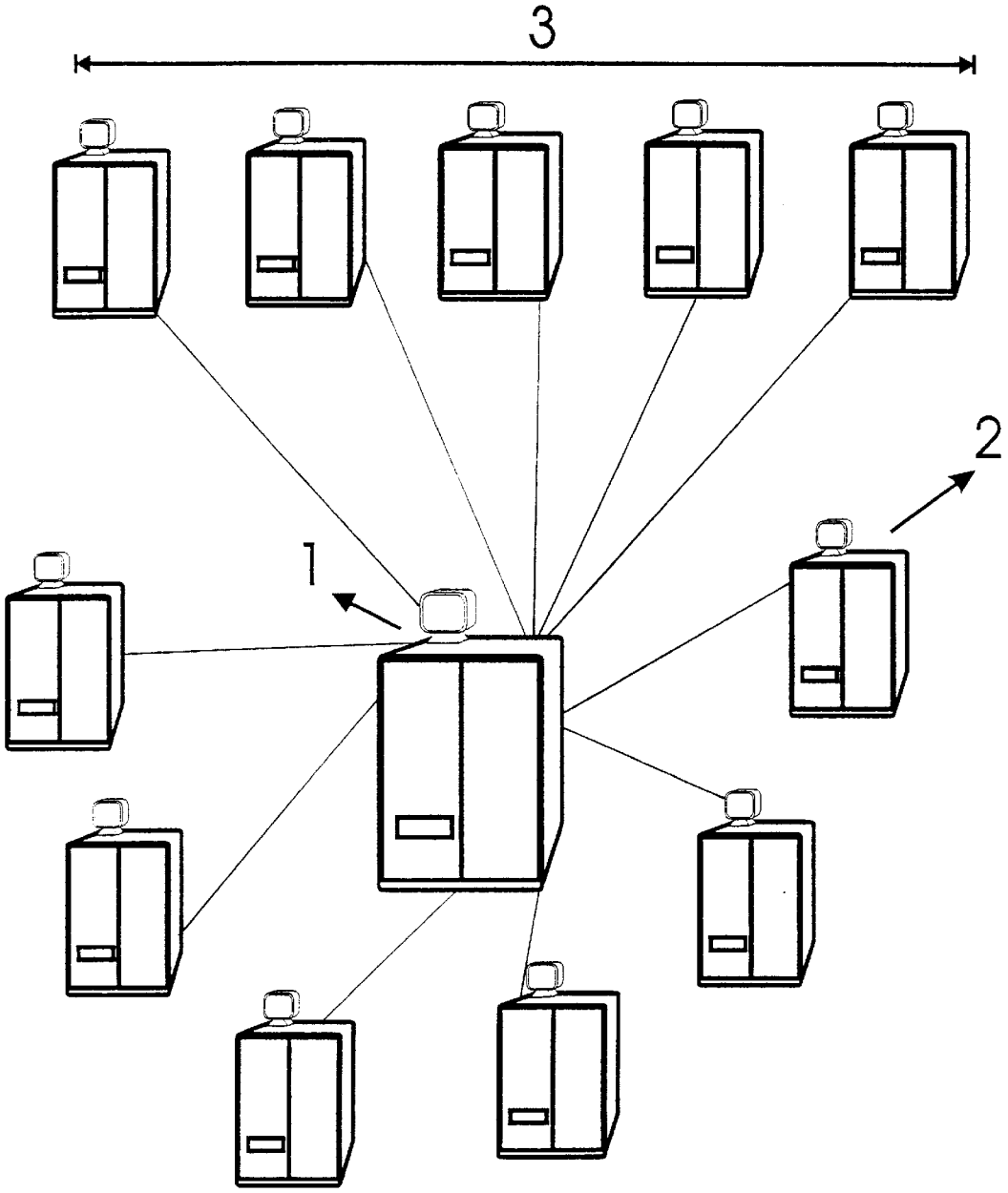
FIG. 1 illustrates the interaction of a central distribution unit, a plurality of electronic bookstores, and a plurality of electronic text storage devices, in accordance with the subject invention.

The present invention provides a method and system for producing books on-demand; it can reduce the costs and improves the way books, magazines and other printer matters are created and delivered to the customer, helping to preserve both the environment and human health.

The subject invention pertains to a method and a system designed to automatically print and bind books, magazines, and other printed matter. The present invention is a step by step method and a system which are unique and an improvement over existing techniques, for formatting, printing, and binding, for example, a book, a magazine, or other printed material.

The present invention pertains to a series of methods, apparatus and systems which, when assembled together, allow the local printing, binding, and selling of a book, magazine, newspaper, or other printed matter in just a matter of minutes, and for a fraction of what it costs using conventional means. Using the subject invention, each electronic bookstore can have access to millions of titles all of the time, day or night, without ever running out of them or having titles out of print. Each electronic bookstore can provide access to the electronic texts of many books at a lower cost, thus eliminating much of the waste which prevails in the present system. The method described in the present invention is flexible; it can allow complete searches of the contents of the texts and can allow the reformatting of the size and type of fonts to accommodate, for example, the needs of visually challenged people. The present method allows for large type formatting and printing on demand.

The present invention ameliorates the problem of waste by allowing the delivery of printed matter on-demand, any time, any place, therefore reducing the waste inherited in excessively large runs of books and magazines. Examples of situations where the subject EBS's can save costs and reduce waste include school systems, libraries, bookstores and corporations which need to print and bind, for example, employee manuals on-demand. Specifically, a school could utilize an EBS to print textbooks for students, wherein the text files can be accessed directly from the publishers and only the number of textbooks actually needed can be printed. Accordingly, the publishers do not print extra textbooks that go to waste and schools do not have to purchase extras, just in case, that go to waste.

Another benefit of the present invention, is to allow many more authors to publish their books in an economical fashion. Today, the publishing industry is affected by the ever rising costs of printing ever larger runs, therefore making it almost impossible for non-commercial writers to publish their works. Vast amounts of knowledge are lost when authors are not capable of publishing their books due to a small predicted audience or market. Certain types of books are more difficult to sell. Therefore, authors in subjects such as poetry, philosophy, science, and theater can find it difficult to publish their work due to the high investment required to print the books in the conventional manner.

Advantageously, the present invention can utilize, for example, the Internet as a means of distribution in order to provide on-demand delivery. Writers can become their own publisher if their works are rejected through the conventional publishing channels. Accordingly, authors can make their works available to a wider audience. The present invention can also reduce the overall costs of producing books. The subject invention can increase the accessibility of knowledge, both in time and in price.

In a specific embodiment of the present invention, referring to FIG. 1, at least one central distribution unit (CDU) 1 is connected, for example through a modem and through a telephone line, a satellite link, cable feed, wireless system, or some other communication channel, to a plurality of remote electronic bookstores (EBSs) 2 having the same or similar means of intercommunication. The CDU 1 is a device capable of retrieving and distributing large amounts of information stored in the form of electronic bits (electronic text) in, for example, a plurality of computers 3 of different publishers and authors. Image files can also be accessed, for example for graphs, photos, and drawings. The EBS 2 is an apparatus which has the means to receive electronic data sent by the CDU 1, hold it temporarily while the electronic bits are transformed and formatted into book pages and covers, and then send the information to a high-speed printing means. This method of distributing the information to the remote units does not require the EBS to have a large storage capability and, therefore it is extremely economical to operate.

Figure 2A:
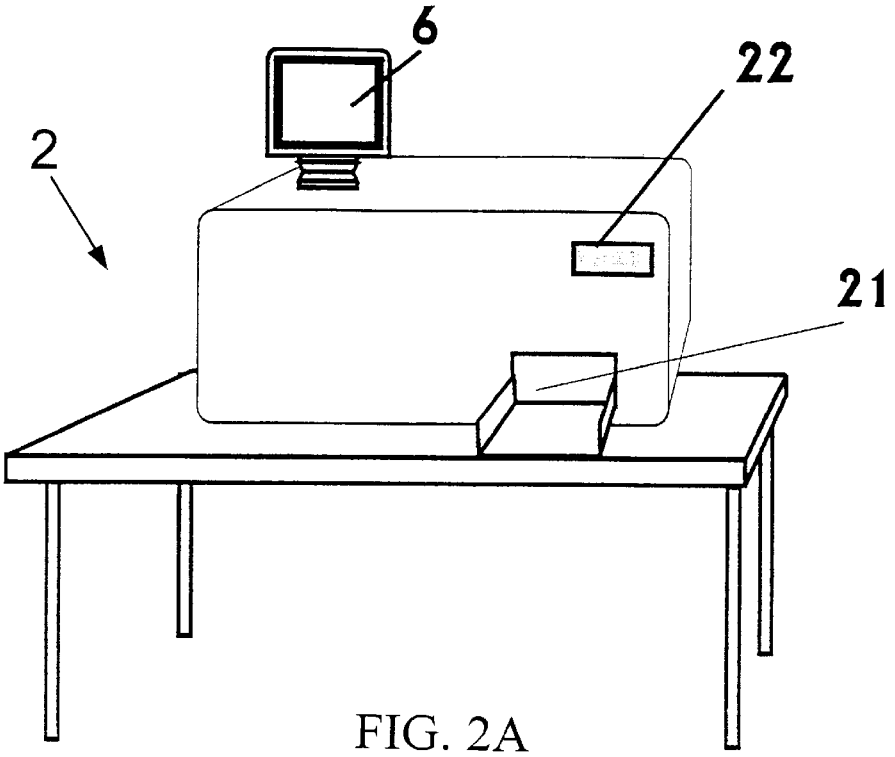
FIG. 2 illustrates an electronic bookstore, in accordance with the subject invention.
Figure 2B:
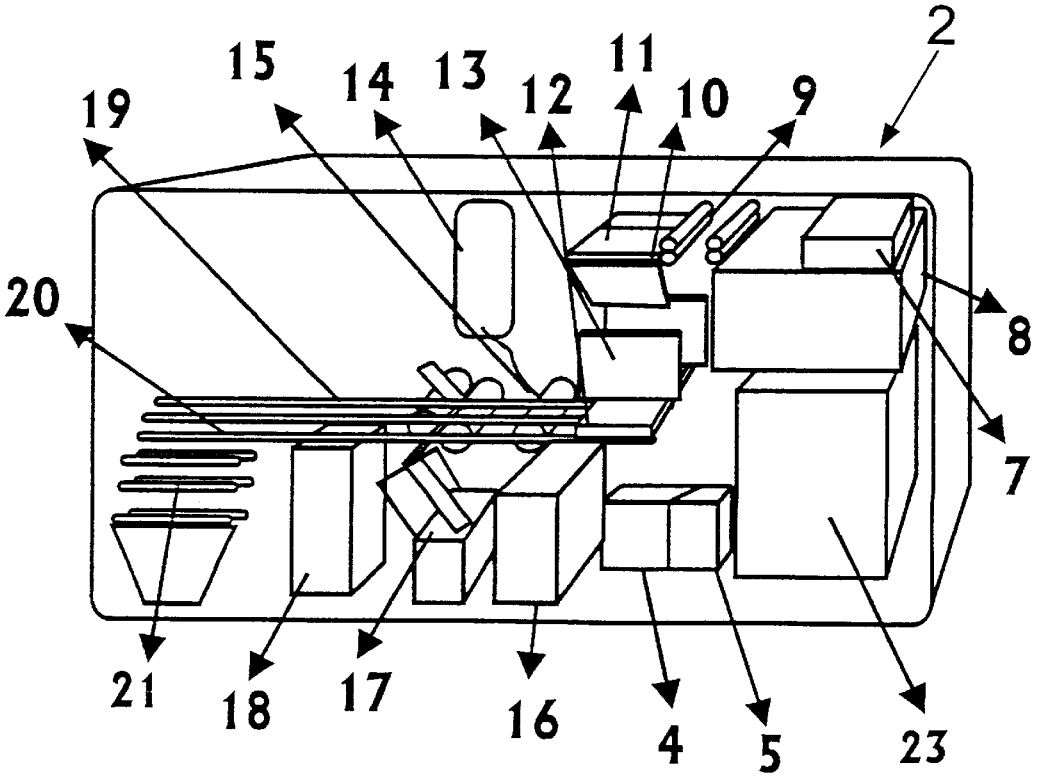

In a preferred embodiment of the present invention, referring to FIG. 2, the EBS 2, can include the following:

- a receiving means 4 to receive data electronically, for example via telephone line, satellite, cable, wireless feed or other type of device to receive electronic data;
- a storage and decoding means 5 for storing and decoding the received data,
- a user interaction means 6 to allow a user to preview the received data and/or provide input to the EBS;
- a distribution means 7 for distributing the data to a printing means 8;
- a printing means 8 for printing the data on, for example, a plurality of loose sheets of paper;
- a transport means 9 to transport the loose sheets of paper;
- a paper cutting means 10 to cut the sheets of paper and, preferably, to notch the 'spine' edge of the book pages to prepare them to receive the glue which will bind them together in a book form,
- a holding means 11 to hold the loose sheets of paper;
- a clamping means 12 to clamp the loose sheets of paper into a book block and transport said book block through the rest of the process;
- a stacking means 13 to stack, vibrate and align the lose sheets of paper into a single book block,
- a glueing means 14 to apply cold glue to the spine of the book;
- a cleaning means 15 to clean and collect excess glue;
- a drying means 16 to dry the glue with, for example, hot air and a timer;
- a labeling means 17 to attach heavy-stock strip labels to the spine of the book;
- a folding means 18 to fold the strip labels around the spine of the book;
- a trimming means 19 to trim any excess of strip label or paper;
- a forming means 20 to give the final form to the book;
- a delivery means 21 from which the book will exit the EBS;
- a money collecting means 22 to collect money from a customer; and
- a storage space 23 to store paper and other materials.

In accordance with the subject invention, a customer can browse through an electronic catalog of books on, for example, his computer at home via the Internet, or at a site where a EBS 2 is located, for example through user interaction means 6. User interaction means 6 can be, for example, a touch screen display, a keyboard, a voice recognition system, or any other system to allow a user to provide input and/or preview the information pertaining to available books and/or preview the received data. The electronic catalog can be, for example, a searchable database located at the CDU 1, the EBS 2, publishers storage facilities 3, or a separate location. In a preferred embodiment, a customer can search the contents of one or more books stored in a plurality of publishers computers 3 to find the books that are suited to the customers needs. Once the book(s) is chosen, a customer can then request the book(s) be printed and bound at a conveniently located remote electronic bookstore 2.

Figure 3:
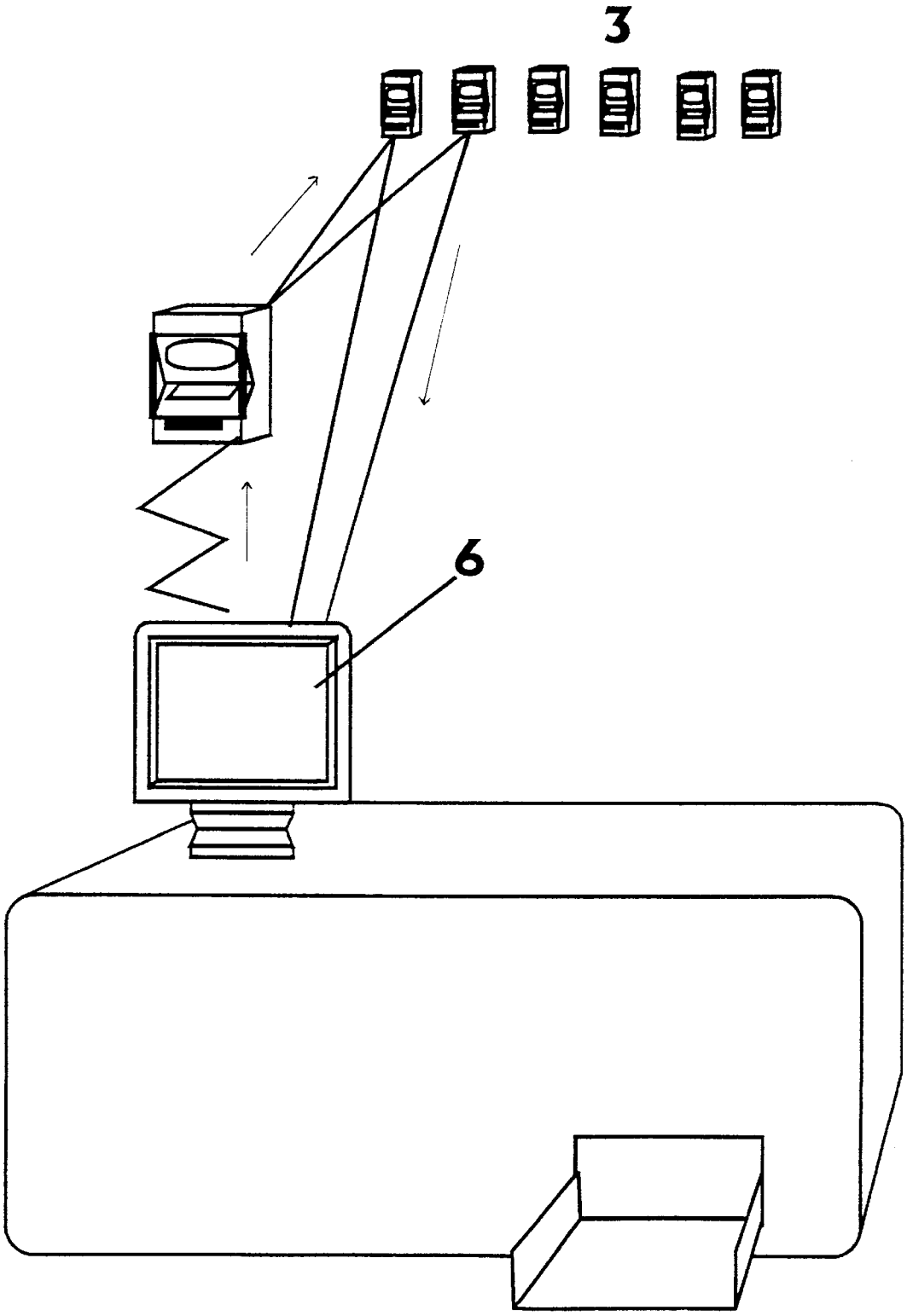
FIG. 3 illustrates a specific example, in accordance with the subject invention where an EBS communicates with a CDU to request data corresponding to selected books and the CDU communicates with publisher's computers to have the requested data sent directly from the publisher's computers tot he EBS for printing and binding.

In a specific embodiment, referring to FIG. 3, when a customer requests a book be produced at a EBS 2, the device which receives the request information can electronically send, for example, an encoded signal, to a CDU 1. The CDU 1 can decode the signal and, upon approval of the code, can send the order to the appropriate publisher whose computer 3 holds the book in, for example, electronic text (bits) file. Another code can be utilized in the communication from the CDU 1 to the publisher to enhance security. The computer of the selected publisher can then release the electronic text (bits) file directly to the appropriate EBS 2, or release the text file to the CDU 1 which can redirect the text file to the appropriate EBS 2. In a specific embodiment, the CDU 1 registers the sale of a single unit of the book and sends signals to the author, the publisher, and/or the EBS indicating said sale for accounting purposes.

In another specific embodiment, the EBS 2 can communicate directly with a publishers computer storage device such that the publisher's computer storage device can send the text data for the book and control data corresponding to how many copies of the book can be printed.

Figure 4:
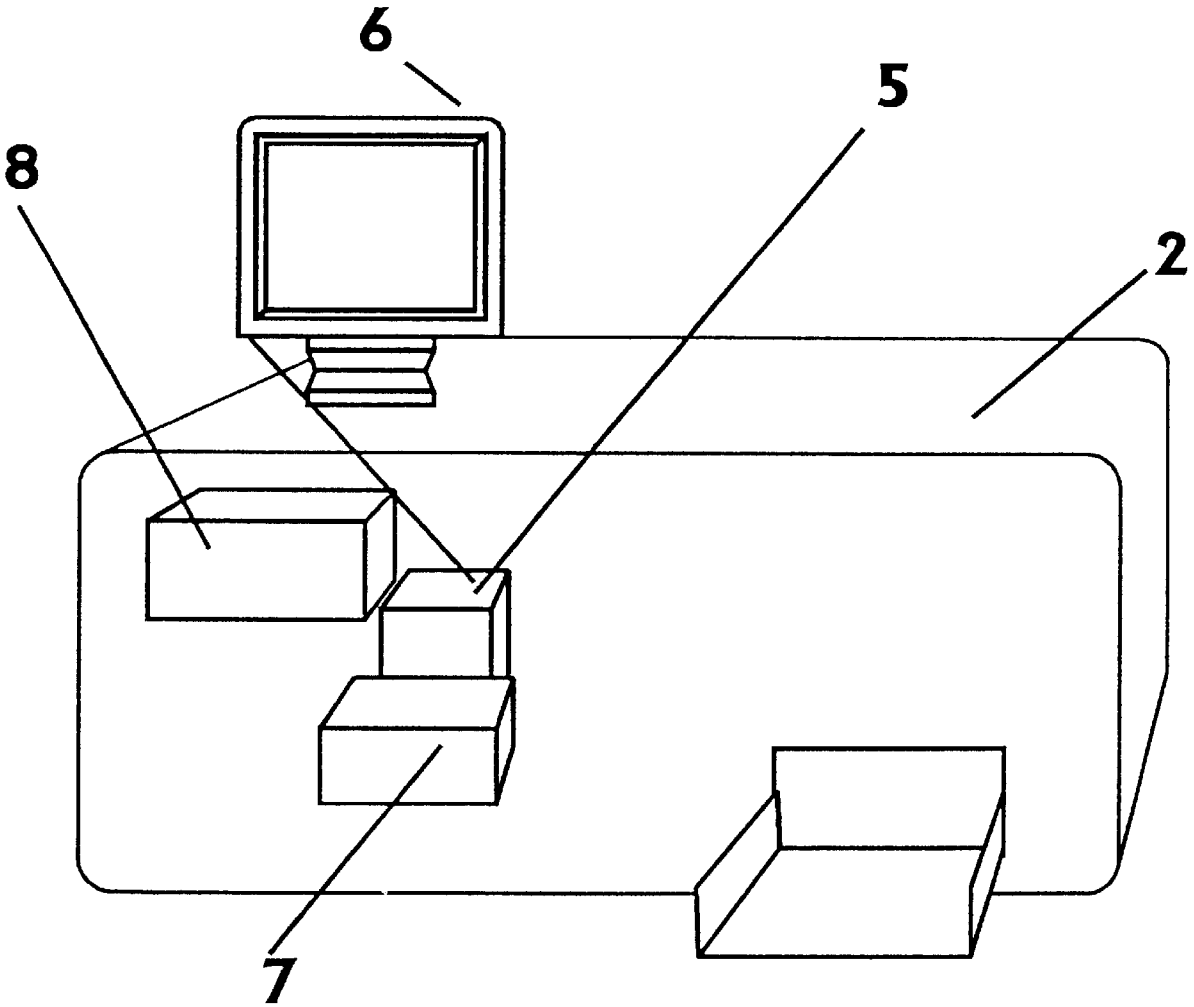
FIG. 4 illustrates the interaction of a storage and decoder means, a user interaction means, a distribution means, and a printing means of an EBS in accordance with the subject invention.
Figure 5A:
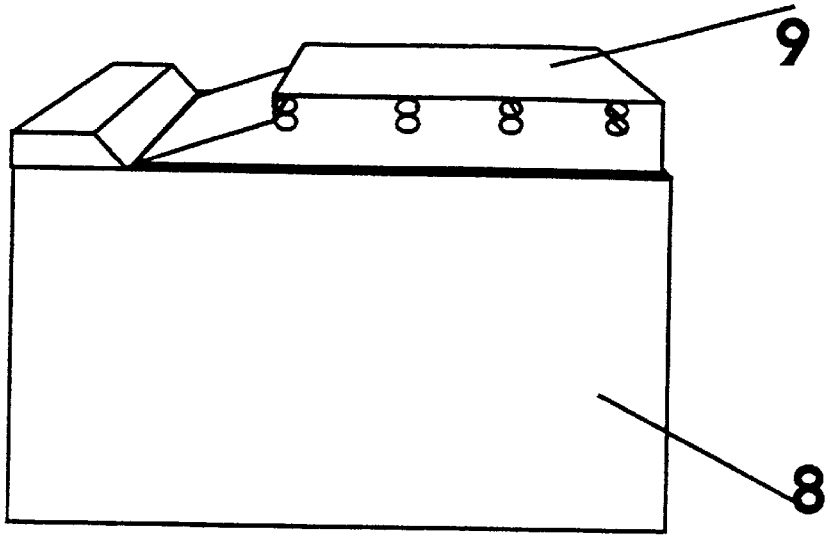
FIG. 5 illustrates the interaction of a printing means, a paper transporting means, and a cutting means of an EBS in accordance with the subject invention.
Figure 5B:
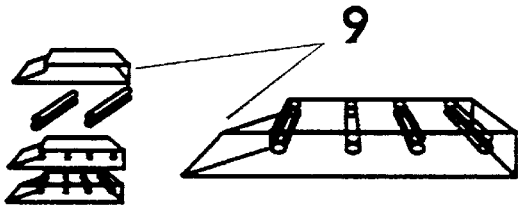
Figure 5C:
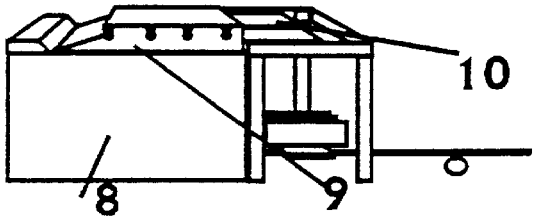
Figure 5D:
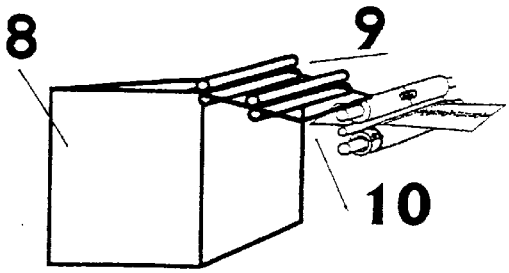
Figure 5E:
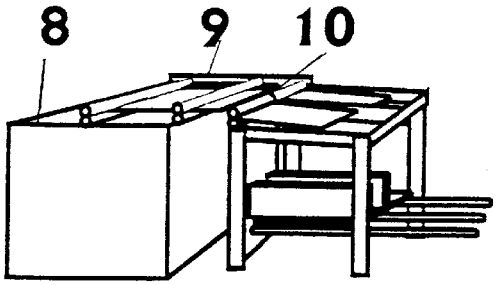

Referring to FIG. 4, the EBS 2 can receive the electronic text (bits) file of the book in electronic data, and the storage and decoder means 5 can transform said data into information for the user interaction means 6 and the software control and distribution means 7. Some of this information, for example, paper size, font size, and type, which is of great importance for visually challenged people, may be altered by the customer by issuing instructions through the user interaction means 6 according to his/her needs and or desires. The information is preferably held in a temporary type memory able to hold, in a transient manner, all of the electronic data pertaining to the content of the book(s) and any formatting information. Once the temporary type memory, for example a hard drive, inside the remote electronic bookstore 2 receives the electronic text, or while it is still receiving, through remote printing commands it can send electronic signals representing the text to be printed to a printing means 8, for example, a laser printer. The printing means is preferably located within the REB housing.

In a specific embodiment, when all the data is received, the EBS user interaction means 6 can allow the customer to chose, for example, the size and type of fonts to be used in the text and the physical size of the book to be produced. This choice of fonts is particularly beneficial for visually challenged readers.

Each book may be produced in a plurality of sizes. In a specific embodiment, four sizes are available, the sizes derived from cutting a commercially sheet of paper measuring 8"×11" (letter size) in two or in four parts, and the sizes derived from cutting a sheet of paper measuring 8"×14" (legal size) in two or in four parts. These four size are 5.5"×8", 4.0"×5.5", 7"×8", and 4"×7". These page sizes allow the use of inexpensive, easily attainable paper. The paper to be used may be a special or commercial grade, of varying quality and weight. In general, the subject invention can accommodate a variety of paper sizes. For example, the subject invention can utilize paper already sized correctly, eliminating the necessity of cutting the paper. When pre-cut paper is used the paper can also be pre-notched, to enhance acceptance of the glue used to bind the pages together. Accordingly, when pre-cut paper is utilized in accordance with the subject invention, a cutting means is not necessary to cut the sheets into book pages.

Once the size of the book is determined, for example by customer choice, special software distributes and formats the text into pages as follows:

For the sheets that will not be cut, a book page can be printed on each side of the sheet.

For the sheets of paper that will be cut in two parts, the scaling and distribution of the pages receives a distribution of 4 by 1 (four pages of the book onto one sheet of paper): that is, two pages on the front of the sheet of paper, and two pages in the back.

For the sheets of paper that will be cut in four parts, the scaling and distribution of the pages receives a distribution of 8 by 1 (eight pages of the book onto one sheet of paper): that is, four pages on the front of the sheet of paper, and four pages on the back.

Figure 18:
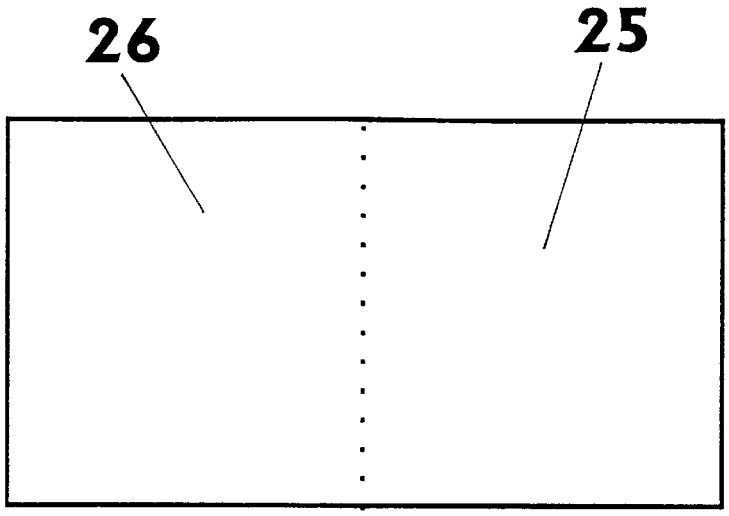
FIG. 18 illustrates book page distribution in the sequence 4 in 1, in accordance with the subject invention.
Figure 19:
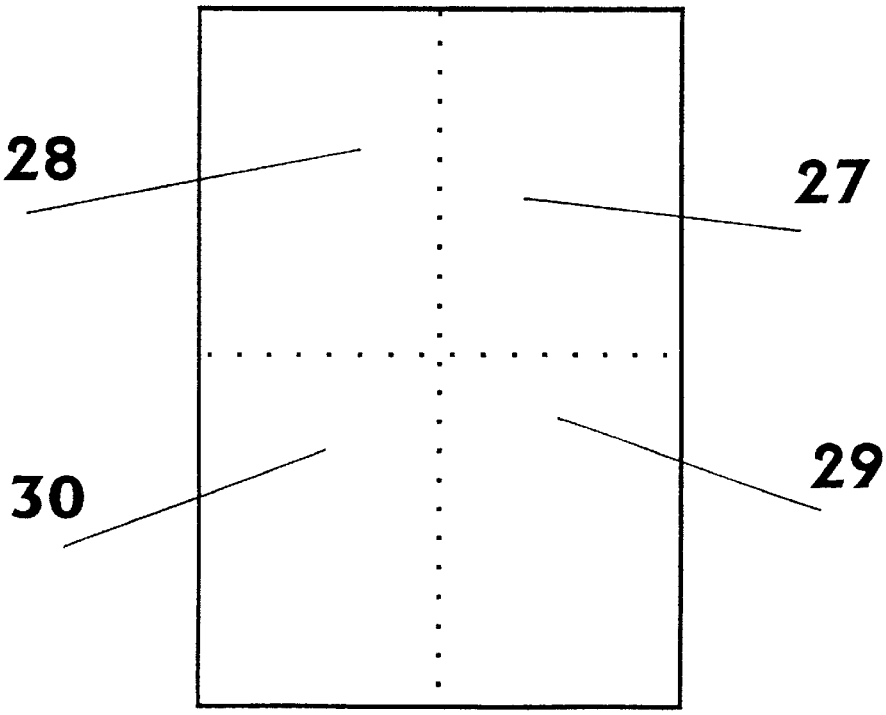
FIG. 19 illustrates book page distribution in the sequence 8 in 1, in accordance with the subject invention.

FIG. 18 corresponds in shape and form to the distribution of the pages in the sequence 4 in 1. FIG. 19 corresponds in shape and form to the distribution of the pages in the sequence 8 in 1

In a preferred embodiment, the software can distribute the pages according to the following examples:

EXAMPLE 1

Sequence 4 in 1

This is the case where 2 pages of the book are printed on the front of the sheet of paper, and the matching 2 pages on the back. The following distribution applies to a plurality of 'n' book pages. This sequence should always work regardless of the number of pages in the book.

a.—The process begins by dividing the total number of pages in the book by 4. The result will be the total amount of sheets of paper needed to print the book. If the resulting number is a fraction, the software can automatically round up the nearest whole number.

b.—In a specific embodiment, the first page of the book can be printed on the front right side 25 of the first sheet of paper, and the last page of the book can be printed on the front left side 26 of the sheet. The second page of the book can be printed on the back of the front right side 25 of the first sheet of paper, while the second to last page can be printed on the back of the front left of the sheet 26. The third page can be printed on the front right side 25 of the second sheet of paper with the fourth page on the back of the front right side 25 of the second sheet. Accordingly the third to last page can be printed on the front left side 26 of the second sheet with the fourth to last page on the back of the front left side 26 of the second sheet. This continues until all 'n' pages, that composes the book, plus any blank pages added in to achieve an even multiple of four are printed. The blank pages added to round up to a multiple of four can be added at, for example, the front or back of the book. For example, if a book has 97 pages there can be three blank pages added at the end of the book, resulting in the front left side 26 of the first two sheets and the back of the front left side of the first sheet being left blank.

EXAMPLE 2

Sequence 8 by 1:

This is the case where 4 pages of the book to be printed are printed on the front of the sheet of paper, and the matching 4 pages are printed in the back. The following distribution applies to a plurality of 'n' number of pages. This sequence should always work regardless of the numbers of pages in the book.

a.—The process begins by dividing the total number of pages in the book by 8. The result will be the amount of sheets of paper needed to print the book. If the resulting number is a fraction, the software automatically can add blank pages to round up to the nearest whole number.

b.—In a specific embodiment, the first page can be printed on the top half of the front right side 27 of the first sheet of paper and the last page can be printed on the top half of the front left side 28, with their corresponding matching pages on the back of the same sheet. The third page of the book can be printed on the top half of the front right side of the second sheet of paper and the third to last page can be printed on the left side of the top half of the second sheet, with their corresponding matching pages printed on the back. This continues until all of the sheets of paper are used on the top half. The software then automatically continues with the process at the bottom half part of the sheets of paper 29 and 30 until the entire amount of the 'n' pages that comprise the book are printed. In this example, if the number of pages is not a multiple of eight, blank pages can be inserted in a manner analogous to the previous example 1.

In both of the above examples, it is preferred to print the cover first. The cover can be printed on a heavier stock paper which can be located in an additional paper bin.

Referring to FIG. 4, the distribution means 7 distributes the information to the printing means 8 regarding the size of each sheet of paper, number of pages to print onto each sheet of paper, ways of distributing said pages into the sheets of paper, numbering of said pages, order in which they are to be printed, type and size of fonts to be used, design of the printed matter, graphics to be included, etc. Some of this information, for example paper size, font size, and type, may be changed by the customer according to the customer's needs. Upon receiving the information, the printing means 8 preferably prints on both sides of each sheet of paper at the same time, in the manner requested by the customer through the user interaction means 6 and the distribution means 7. When four or eight pages are printed onto each sheet, the speed of printing the book can be increased. In a specific embodiment, a plurality of printers can be utilized to further speed up the printing of a book. The pages can be printed on commercially available bond paper, while the covers can preferably be printed from, for example, a second tray in the printer, to allow the covers to be printed on a heavier stock. The heavier stock used for the covers can also be commercially available.

In a preferred embodiment of the present invention, the system is designed to allow only one copy of each ordered book to be printed. Specifically, when the printing means 8 finishes printing the data, the distribution means 7 can erase the text data from the memory of the REB 2. In a preferred embodiment, the system is designed such that each EBS will only print a designated number of printings of each book, the text of which is transmitted from a CDU 1 or publisher's computer. A code, for example an encrypted code, can be used to tell if the EBS has been tampered with. This method improves the way the information is handled because it insures that each printed unit of the book will be reported back to the author and/or publisher, who then will be able to collect royalties from the vendor. Accordingly, the owner of the book receives payment for each individual unit of the book sold and is less likely to have the book pirated.

Referring to FIG. 5, as the first sheet of paper exits the printing means 8, it can pass through a sensor, for example, an electronic sensor, that triggers the paper transporting means 9. The paper transporting means can serve at least two purposes. First, it can direct the paper in a certain path and center the sheets of paper. In addition, the paper transporting means 9 can move each sheet of paper into the proper position for the paper cutting means 10. The paper cutting means can cut the paper into the requested size for the pages that form the book. Preferably, the paper transporting means 9 can hold the paper while the paper cutter slices the sheets, and then the paper transporting means 9 can deposit those smaller sheets of paper onto, for example, a paper tray. In a preferred embodiment, the paper sheets are cut one at a time after exiting the printing means. In an alternative embodiment, a plurality of sheets can be cut at a time.

Figure 6A:
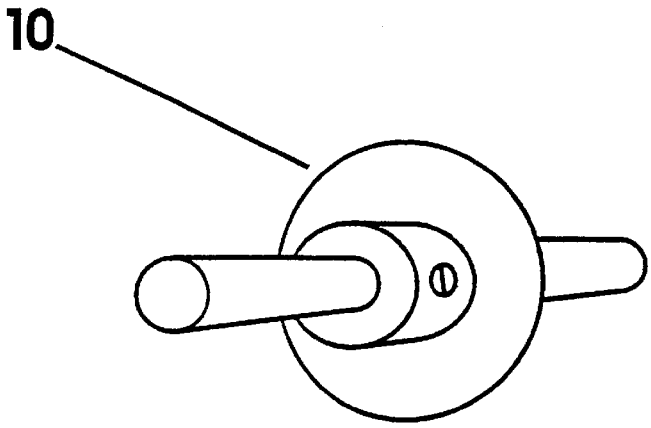
FIG. 6 illustrates a cutting means with a specific notching pattern, in accordance with the subject invention.
Figure 6B:
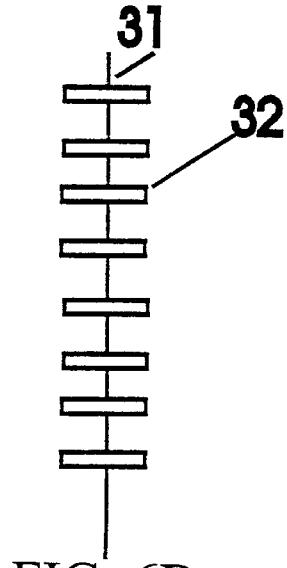
Figure 6C:
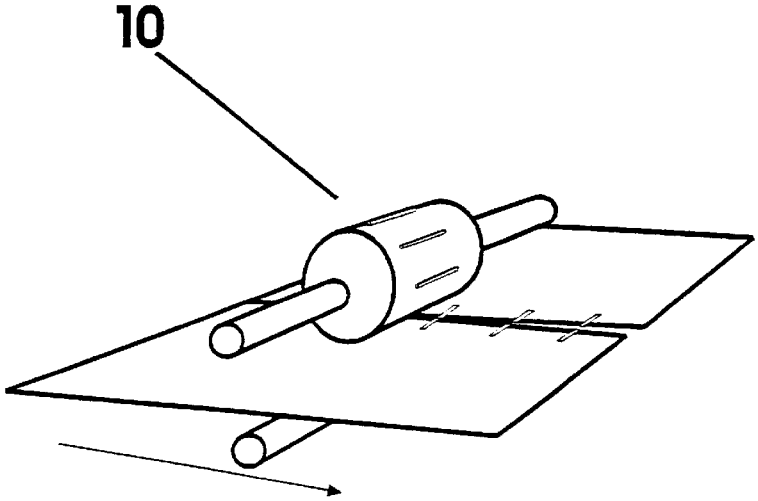

Referring to FIG. 6, the paper cutting means 10 can cut the edges of the paper in a pattern that, for example, can be composed of a vertical cut 31 and a series of horizontal cuts 32 which, for example, can create notches. Other notch patterns can also be implemented, for example, a zig-zag pattern which allow triangular notches or an interlocking notch pattern. In a preferred embodiment, the sheets are cut and notched at the same time, for example with a single circular cutting instrument which comprises a cutting surface which implements the desired notch pattern. This way of cutting the individual sheets of paper exposes the fibers of the paper and allow for a stronger binding of the pages once the glue is applied. The edge pattern can create filaments that cross the spine of the book and, once dried, serve the same purpose as traditional book sewing.

The cuts in the paper are produced along the inside edge of the pages, namely the side that will be the spine of the book. This is done so the sheets of paper will be cut down to the proper size and shape for the pages that form the book block. The shape of the cut in the paper will insure that once the paper is gathered into a book format, the spine of the paper will expose enough fibers to allow the proper gluing of the spine and, therefore, achieve a stronger bond between the pages themselves and the spine cover of the book. This is an improvement over the traditional methods of roughening the spine after the book block is formed. It saves time of production, improves quality of results, and improves the process by allowing even the thinnest of books (a few dozens of pages) to be bound together in a long-lasting manner.

It is preferred that the depth of the notches be in the range of about 0.5 mm to about 1.5 mm, in order to allow for sufficient binding strength of the glue without creating difficulty in aligning the book pages with each other to form a book block. More preferably, the depth of the notches should be approximately 1.0 mm.

In a specific embodiment, the notches can be accomplished after the pages are brought together to form a book block, for example by a circular sawing means. In this embodiment, the sides of the sawing blade can rough the sides of the notches to enhance the adhesion of the glue. Other techniques for notching the pages would be apparent to a person in the art with the benefit of this disclosure.

In an alternative embodiment, the book pages can be printed on pre-perforated paper sheets which can be ripped into book pages, wherein the perforated edges can enhance the adhesion of the glue. Accordingly, notching is then optional.

In a preferred embodiment of the subject invention, a cold water based glue can be utilized. Although other glues can also be used, for example hot glues. Advantageously, cold glue fumes are not harmful to humans and, therefore, the use of cold glue is not as expensive to implement as the use of hot glue is. Advantageously, a book bound with cold glue in accordance with the subject invention can have a flexible spine, allowing the book to be opened flat.

Figure 7A:
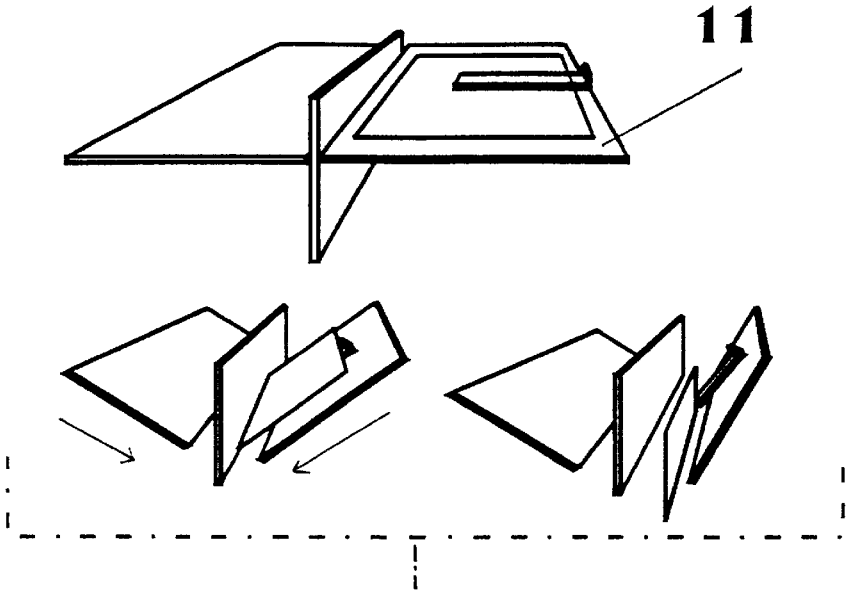
FIG. 7 illustrates a paper-tray station for holding the book pages after printing and cutting, in accordance with the subject invention.
Figure 7B:
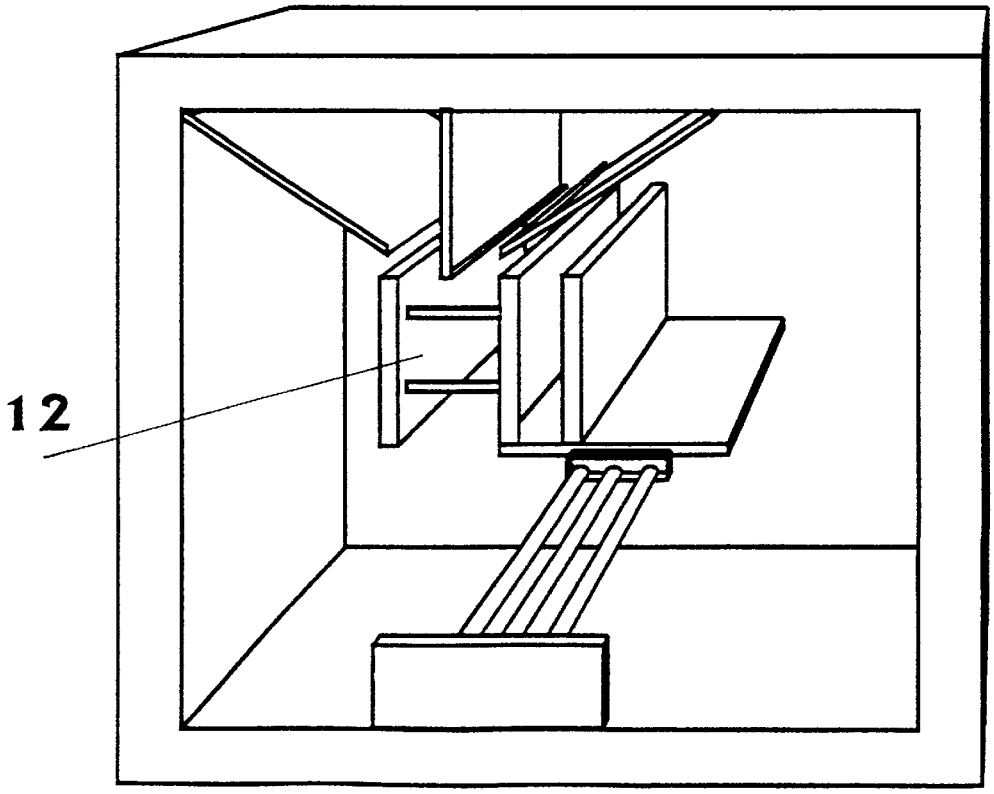

Referring to FIG. 7, once cut, the smaller sheets of paper can be deposited onto the paper-tray station 11 that holds the smaller loose sheets of paper one on top of other until the printer finishes printing all of pages of the book.

Figure 8A:
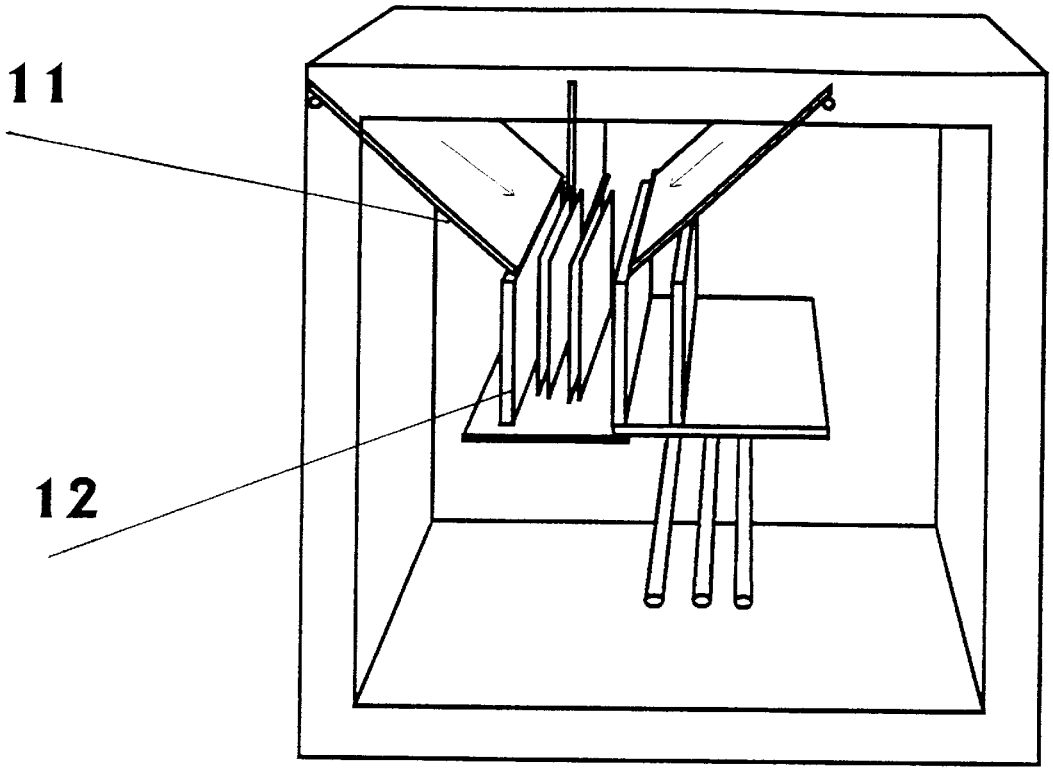
FIG. 8 illustrates a movable clamping means which can hold the book pages as a book block, in accordance with the subject invention.
Figure 8B:
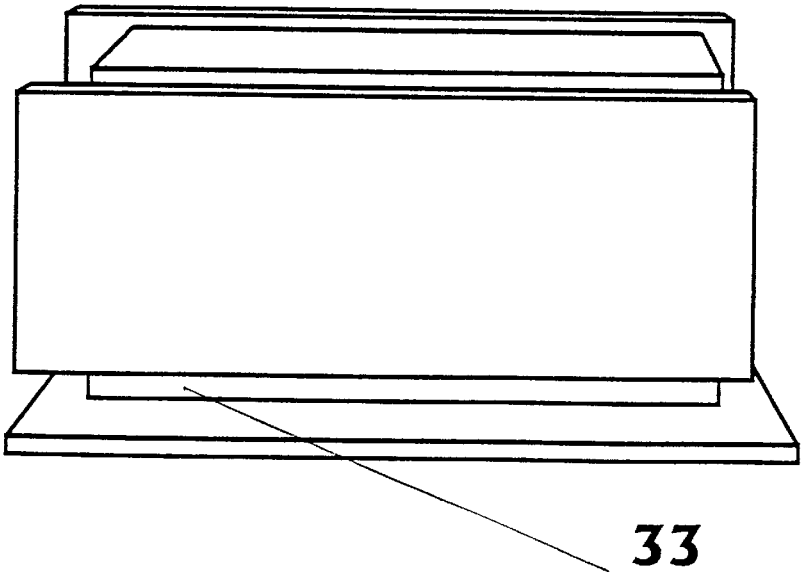

Referring to FIG. 8, when the printing means finishes printing all the sheets of paper and stops, a sensor can send a signal for the paper-tray station 11 to open and release the plurality of sheets into, for example, a movable clamping means 12 such that all of the pages become a single book block. These pages can be numbered and collated in such a way that a specific edge of the paper 33 is sufficiently exposed to attach the cover. This space is preferably about ¼". This exposed edge is the spine of the book, where the cover label will be glued.

Figure 9A:
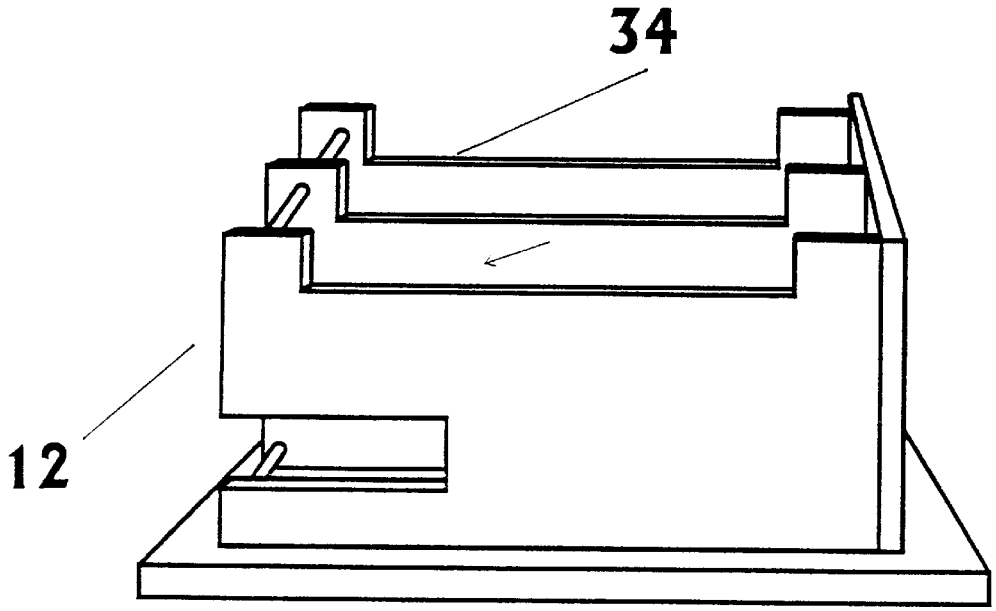
FIG. 9 illustrates the jaws of a clamping means in accordance with the subject invention.
Figure 9B:
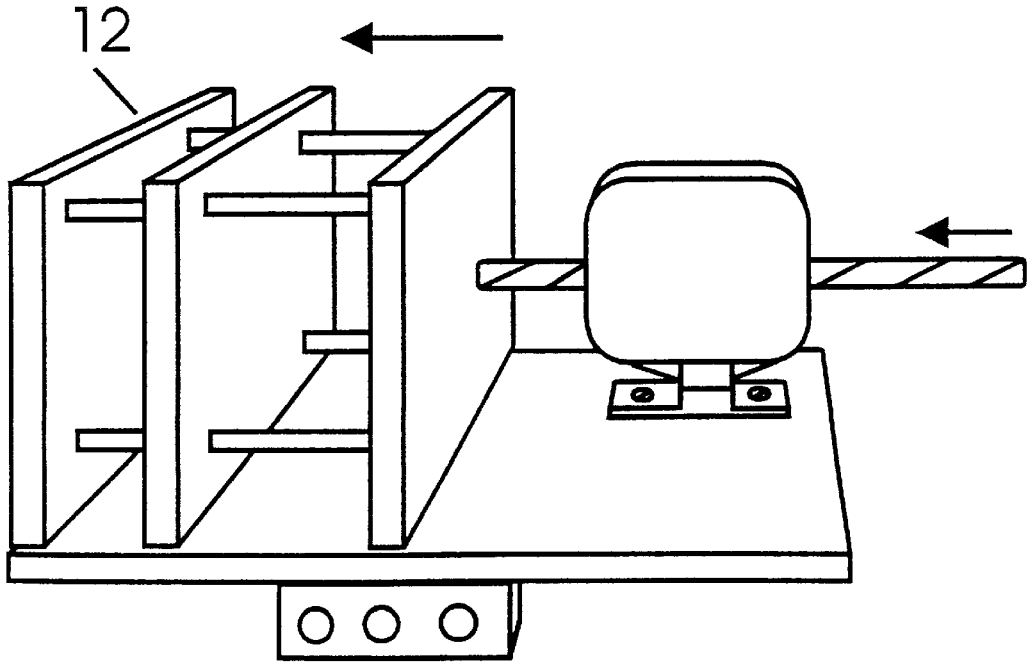

Referring to FIG. 9, in a preferred embodiment, the design of the jaws 34 in the clamping means 12 can force open, in a semi-fan shape, the exposed paper. Accordingly, the paper will receive more of the glue, creating a firmer bind with the cover.

Figure 10:
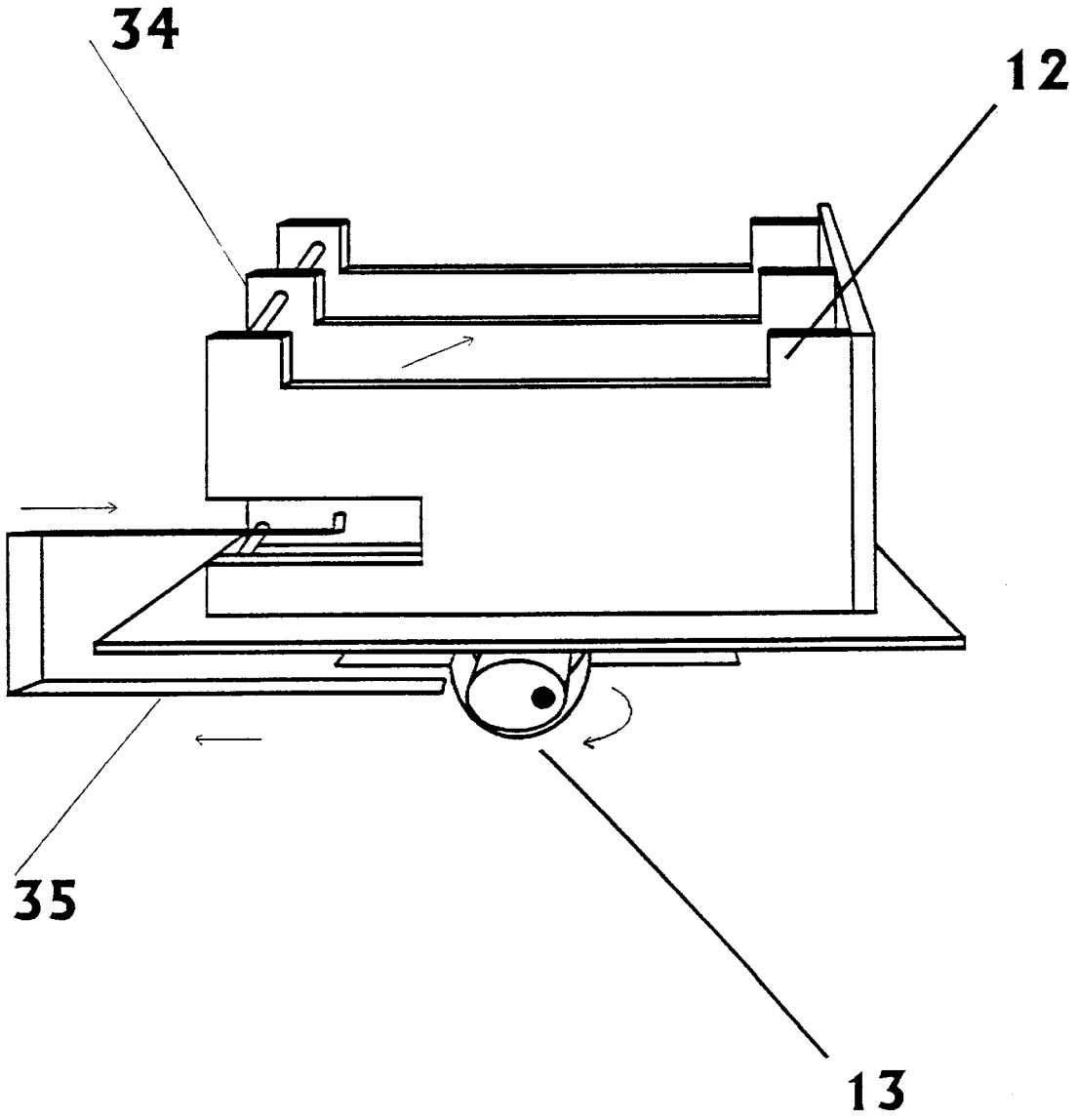
FIG. 10 illustrates a stacking means in accordance with the subject invention.

Referring to FIG. 10, upon receiving all of the book pages a sensor can send a signal to a stacking means 13, for example underneath the floor of the clamping means 12, and cause the stacking means 13 to vibrate. Simultaneously, a horizontal bar 35 can push the sheets of paper and align them into uniform edges to make a rectangular book block. At the same time, the movable clamping means 12 can close its jaws 34 and subsequently tighten the sheets of paper into a single book block unit. In a preferred embodiment, the jaws 34 can close a little bit while the vibrating is stopped and then the sheets can be vibrated some more, and then the jaws 34 can close a bit more, until a book block is formed. This stopping and closing of jaws 34 continues for approximately a few seconds such that all edges of the book block are even.

Figure 11A:
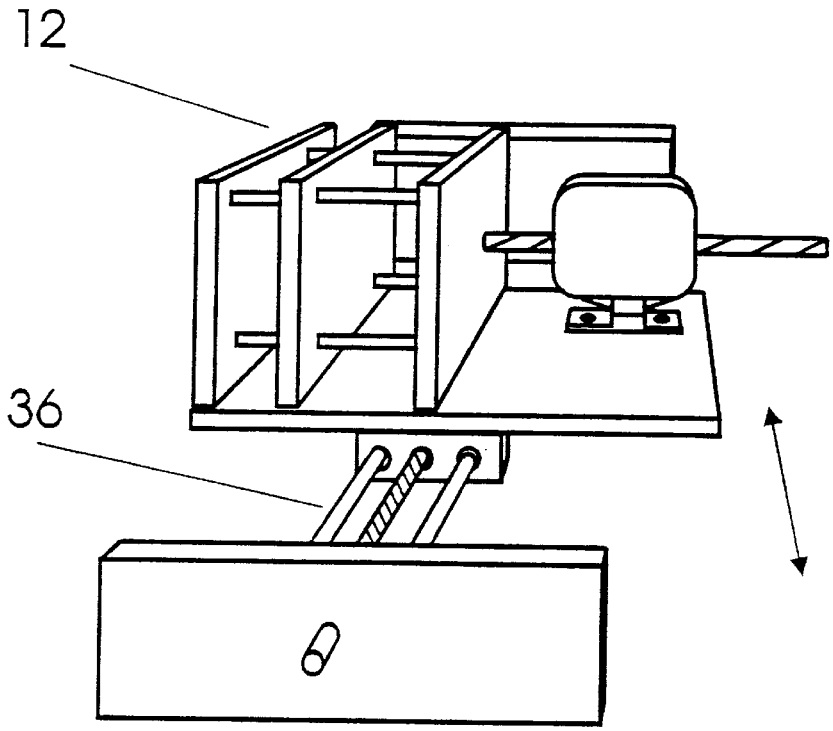
FIG. 11 illustrates a book block moving down a line from where it is formed into a book block to where glue is applied, in accordance with the subject invention.
Figure 11B:
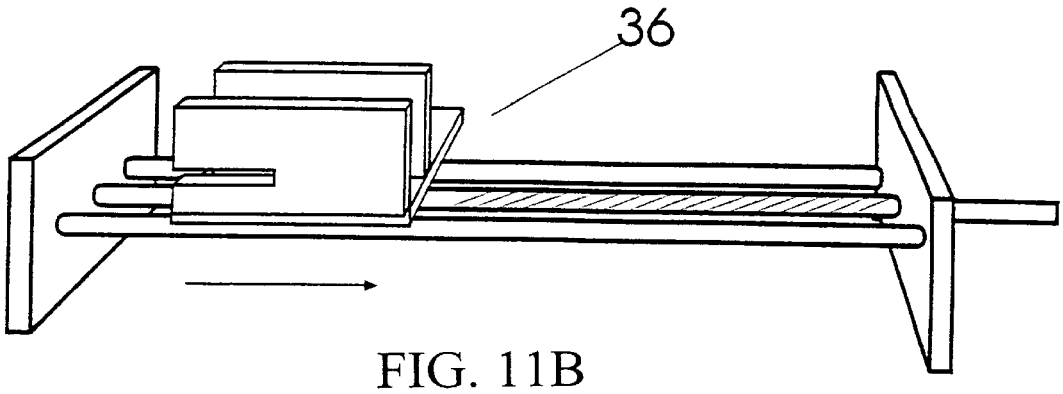

Referring to FIG. 11, when the jaws of the clamping means 12 are closed and holding the book block firmly and tightly, the clamping means 12 can begin to move the book block down the line 36. The movable clamping means 12 can transport the book through the glueing means 14 that applies the glue.

Figure 12A:
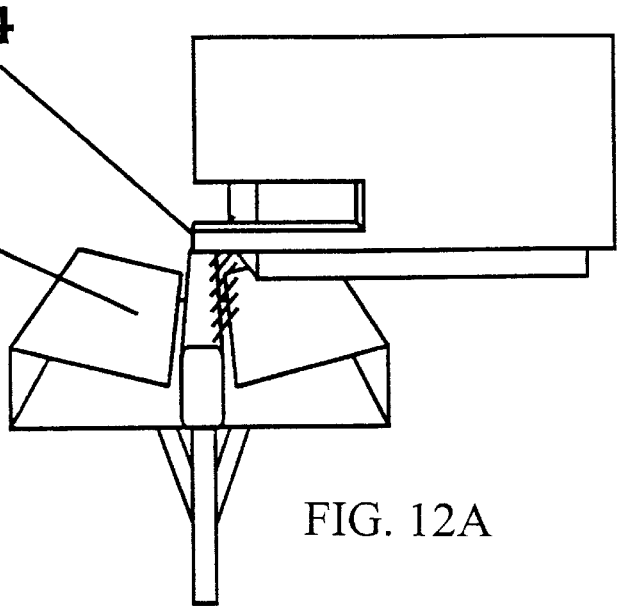
FIG. 12 illustrates a glueing means in accordance with the subject invention.
Figure 12B:
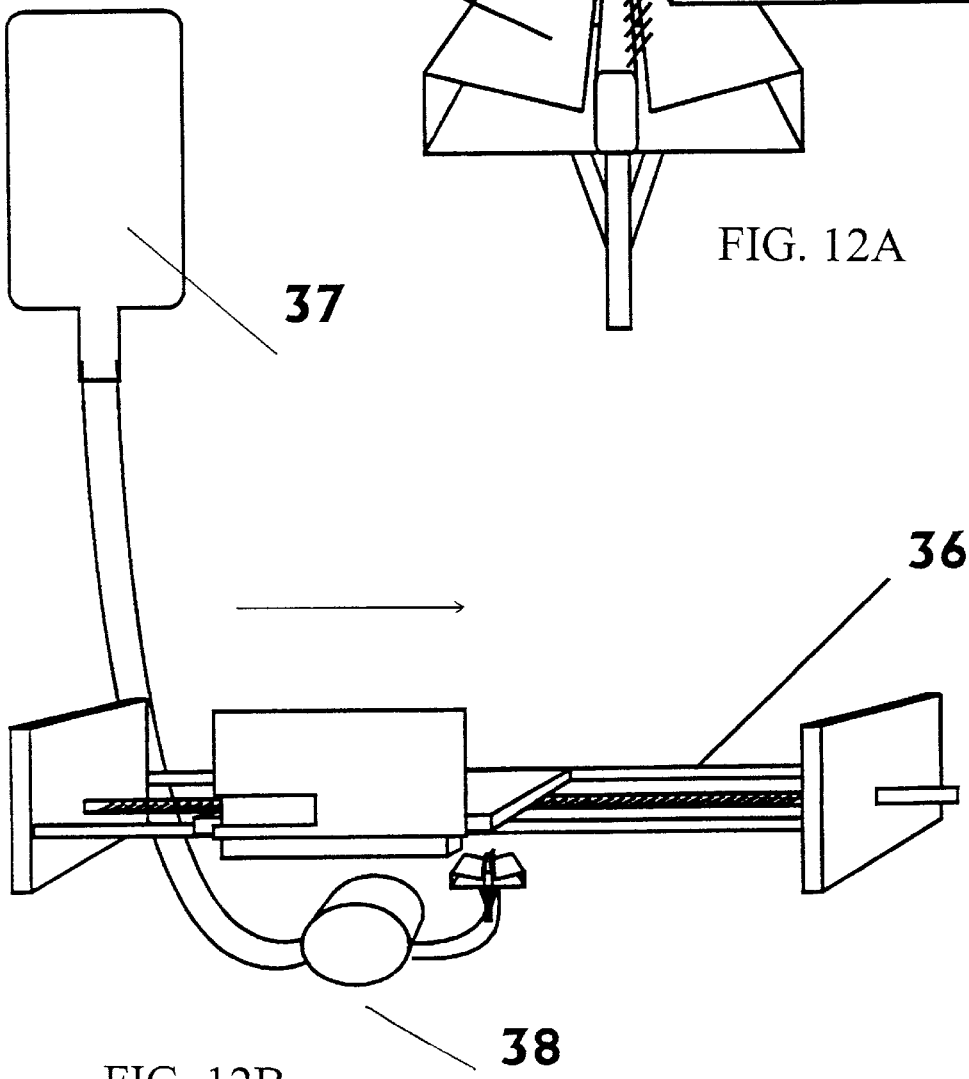

Referring to FIG. 12, the glue is preferably, a water based glue with a liquid viscosity that allows it to penetrate deep into the notches of the paper, improving its adhesive force. Preferably, the subject invention can provide for a fast drying time by, for example, taking out the water with hot air. Preferably, the glue possesses long lasting elastic properties and, therefore, does not become brittle or crisp. Water based glue is safe to use under any circumstance since it does not release harmful fumes, in contrast to the hot glue of thermal binders. Cold glue may be stored indefinitely in a sealed container 37, and may be applied either with a pump 38, a dispersing gun, or other applying means. The movable clamping means 12 can then transport the book block through a glue cleaning means 15 that can clean the excess glue and, for example, spreads it evenly along the spine.

Figure 13:
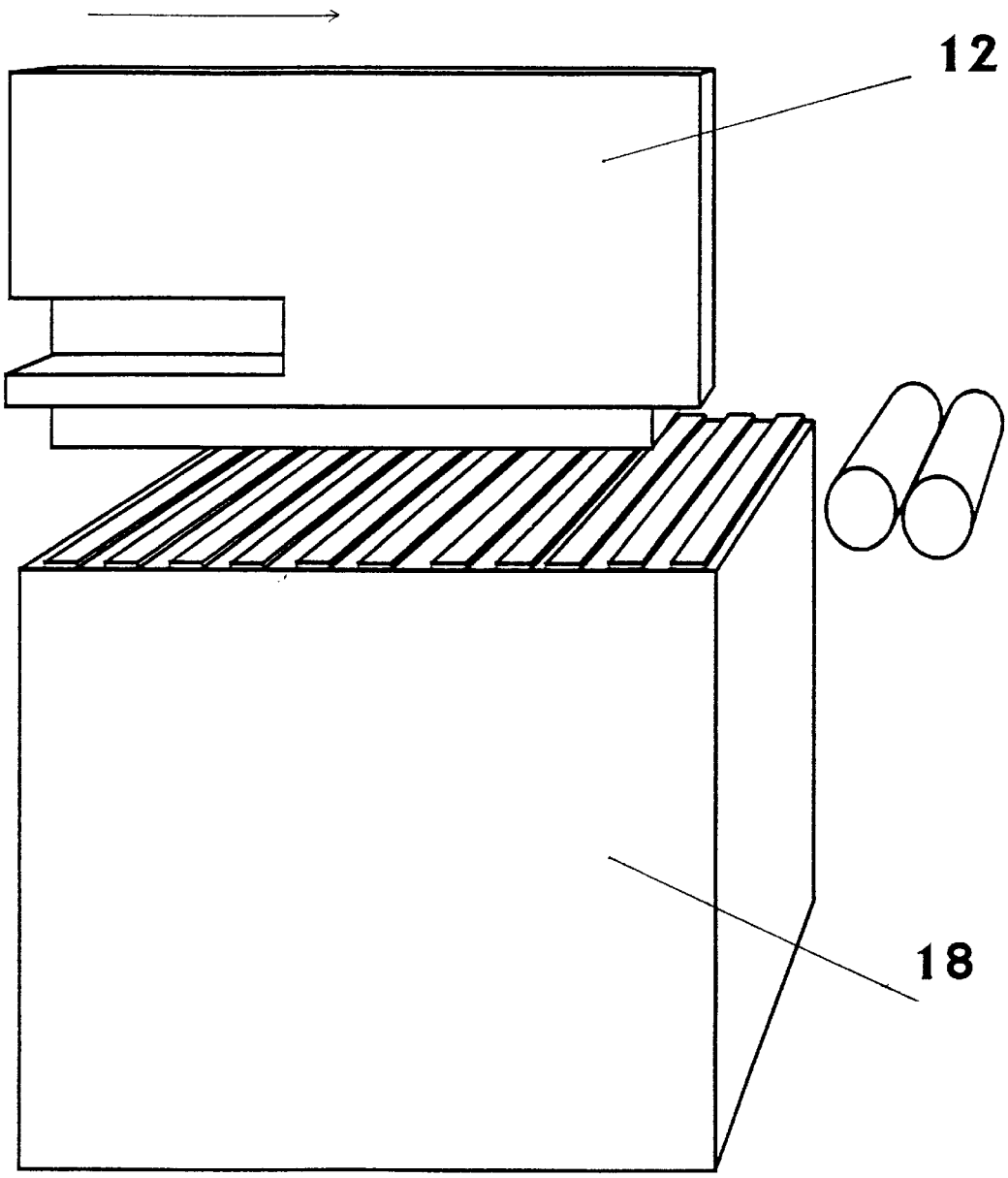
FIG. 13 illustrates a drying means in accordance with the subject invention.

In a preferred embodiment, once the excess glue is cleaned, the book block then continues to the glue drying station. Referring to FIG. 13, when the book block reaches the drying means 18 that dries the glue by, for example, use of hot air, the movable clamping means 12 can stop until a timer and/or sensor signals that the glue is dry.

Figure 14:
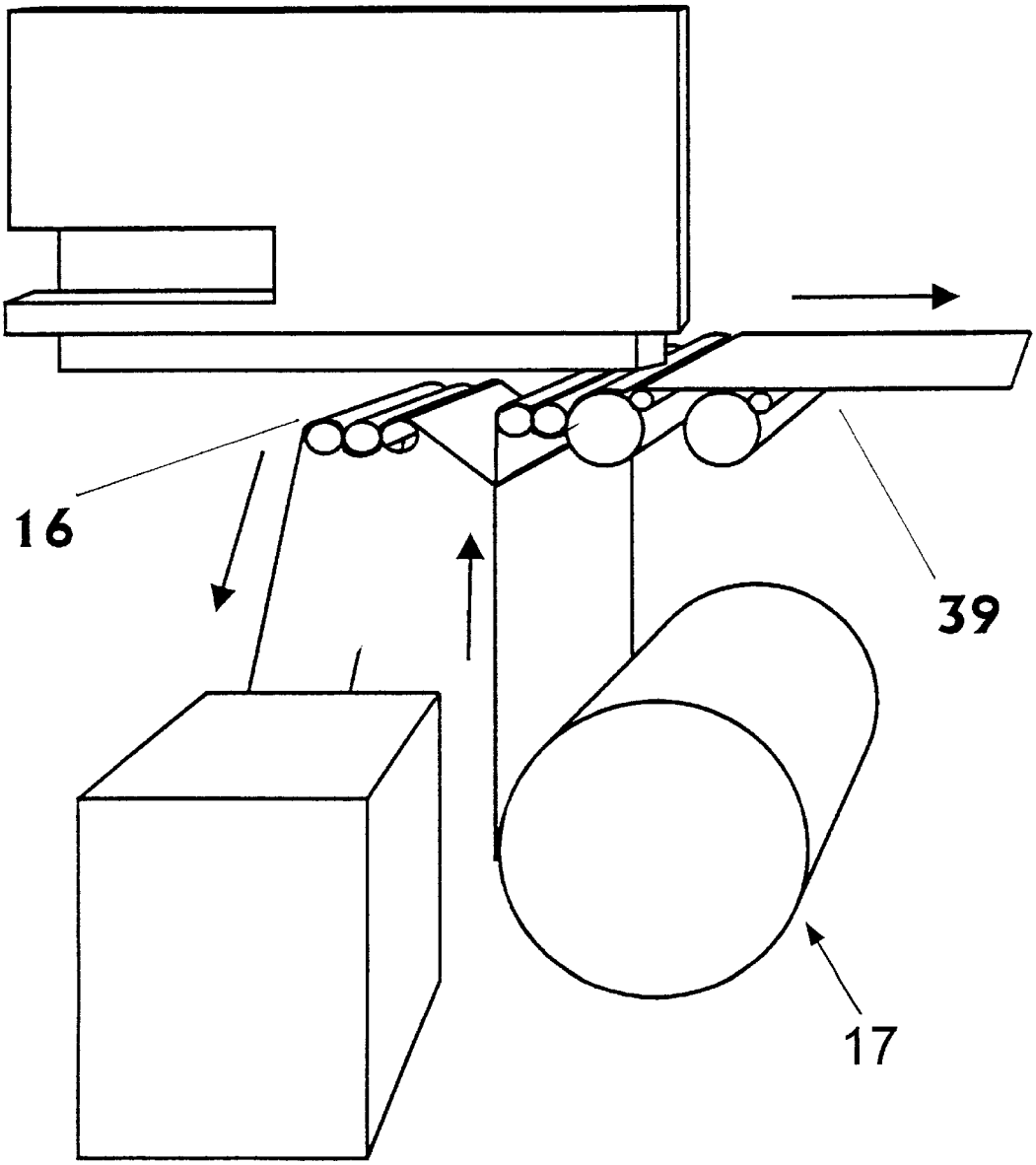
FIG. 14 illustrates a labeling means in accordance with the subject invention.

Referring to FIG. 14, the book block is then moved through the labeling means 17 which can apply a strip label of heavy stock paper to cover the spine of the book. This strip label can have printed on it the international standard book number (ISBN), title, author's name, and/or any other pertinent information. Preferably, the quality and color of the paper can be equal to the quality and color of the heavy stock covers of the book already printed, such that the label is indistinguishablefrom the covers themselves. The self adhesive spine cover label can be provided, for example, by a roller, and deposited into a feeder by a series of rollers that keep it in place and apply the label with precision 39. Since the thickens of each book will vary, the width of the spine cover label can exceed, for example, by at least one inch, the total thickness of an average book 400 pages long. Once the book block reaches the proper place in the line, the cover label can be attached to the book block. In a specific embodiment, one piece of cover stock can have the cover printed on it and can be folded onto and applied to a book block consisting of the book pages, wherein a strip label is optional.

Figure 15A:
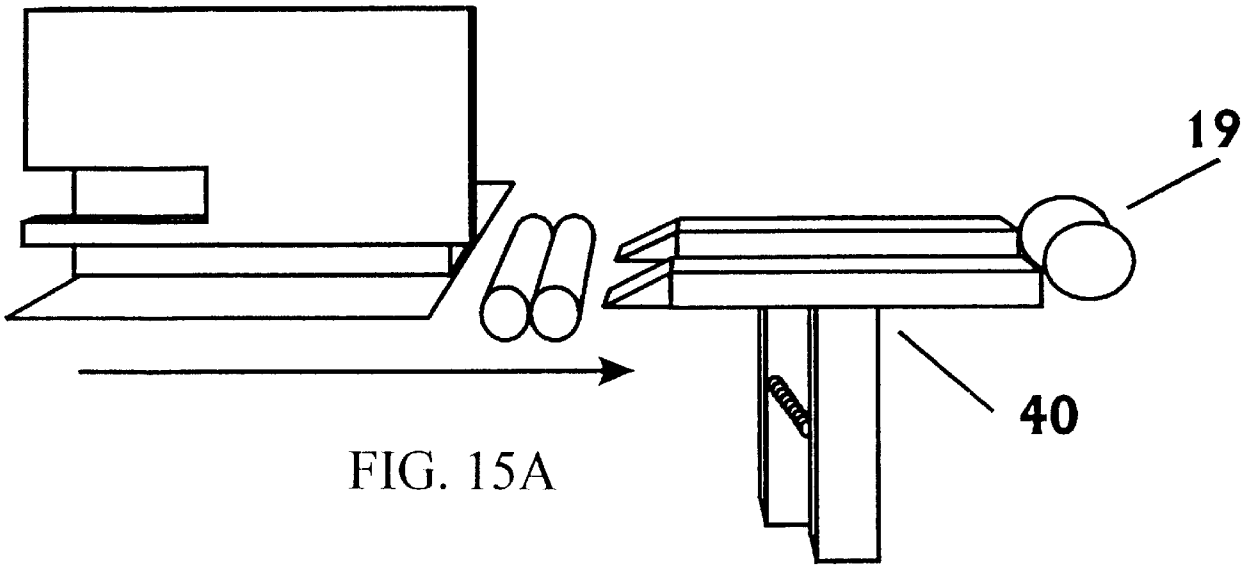
FIG. 15 illustrates a folding means for folding the spine cover strip label up onto both sides of a book spine, in accordance with the subject invention.
Figure 15B:
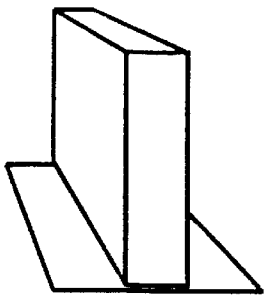
Figure 15C:
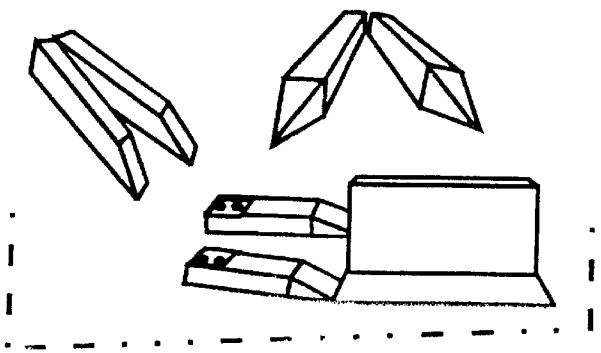

Referring to FIG. 15, the book block continues through the folding means 40 where the spine cover strip label can be folded up by about ¼" up in both sides of the spine by a folding means 18. This folding means 18 also gives the final 'square' edge to the spine of the book. As it leaves the folding means 18, the excess of spine cover strip label can be cut by a trimming means 19.

Figure 16:
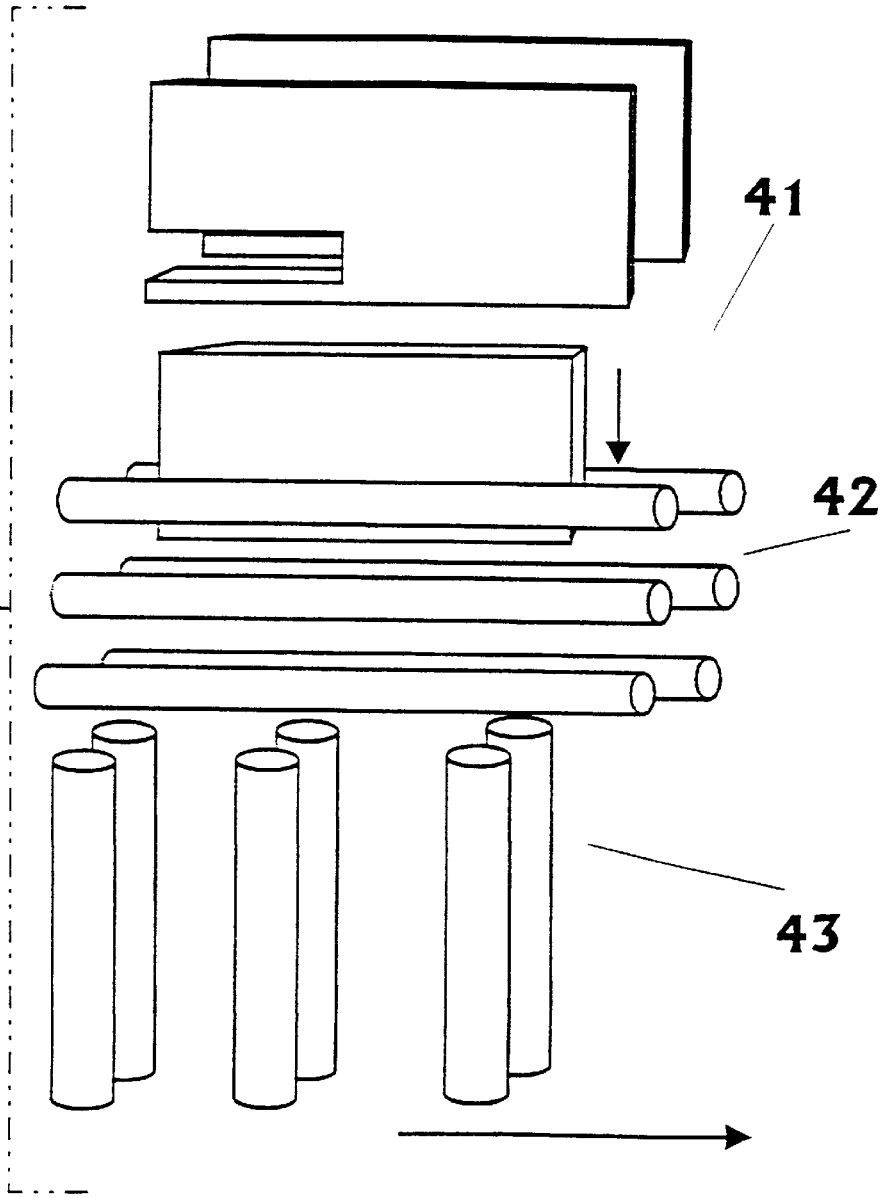
FIG. 16 illustrates final forming means in accordance with the subject invention.

Referring to FIG. 16, the movable clamping means 12 moves the book into the final forming means 41. After the movable clamping means 12 moves the book into the end station, it opens its jaws and releases the book into a final forming means, which in a particular embodiment is made of horizontal 42 and vertical 43 rollers. The book passes in between these rollers. A motor can move the set of moving rollers with their speed controlled by, for example, electronic sensors. The rollers move the book in such a way so as to force it to follow a path. Then the finished book exits the machine through the delivery means.

Figure 17:
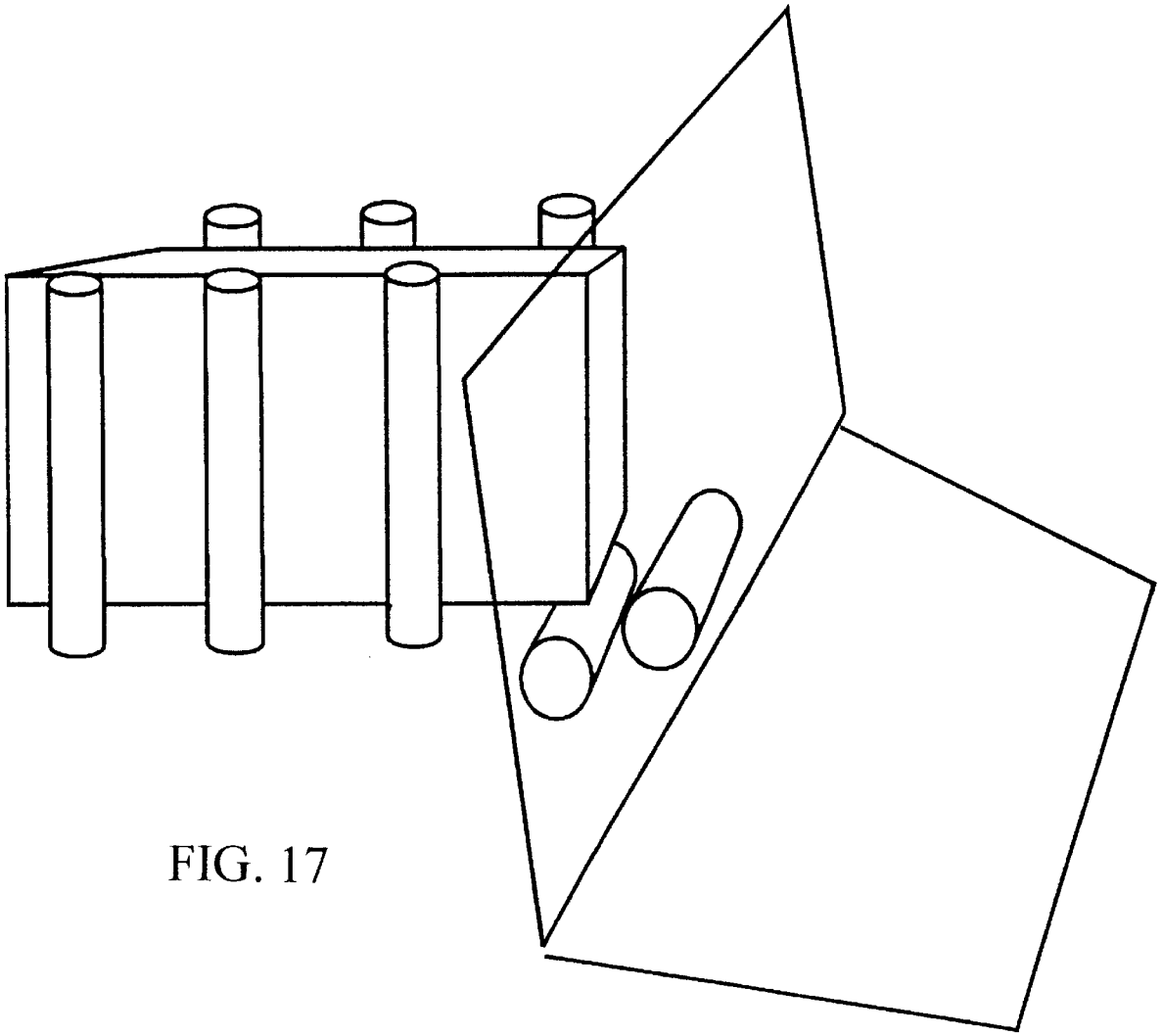
FIG. 17 illustrates a book exiting an EBS in accordance with the subject invention.

Referring to FIG. 17, the finished book then exits the machine.

Figure 20:
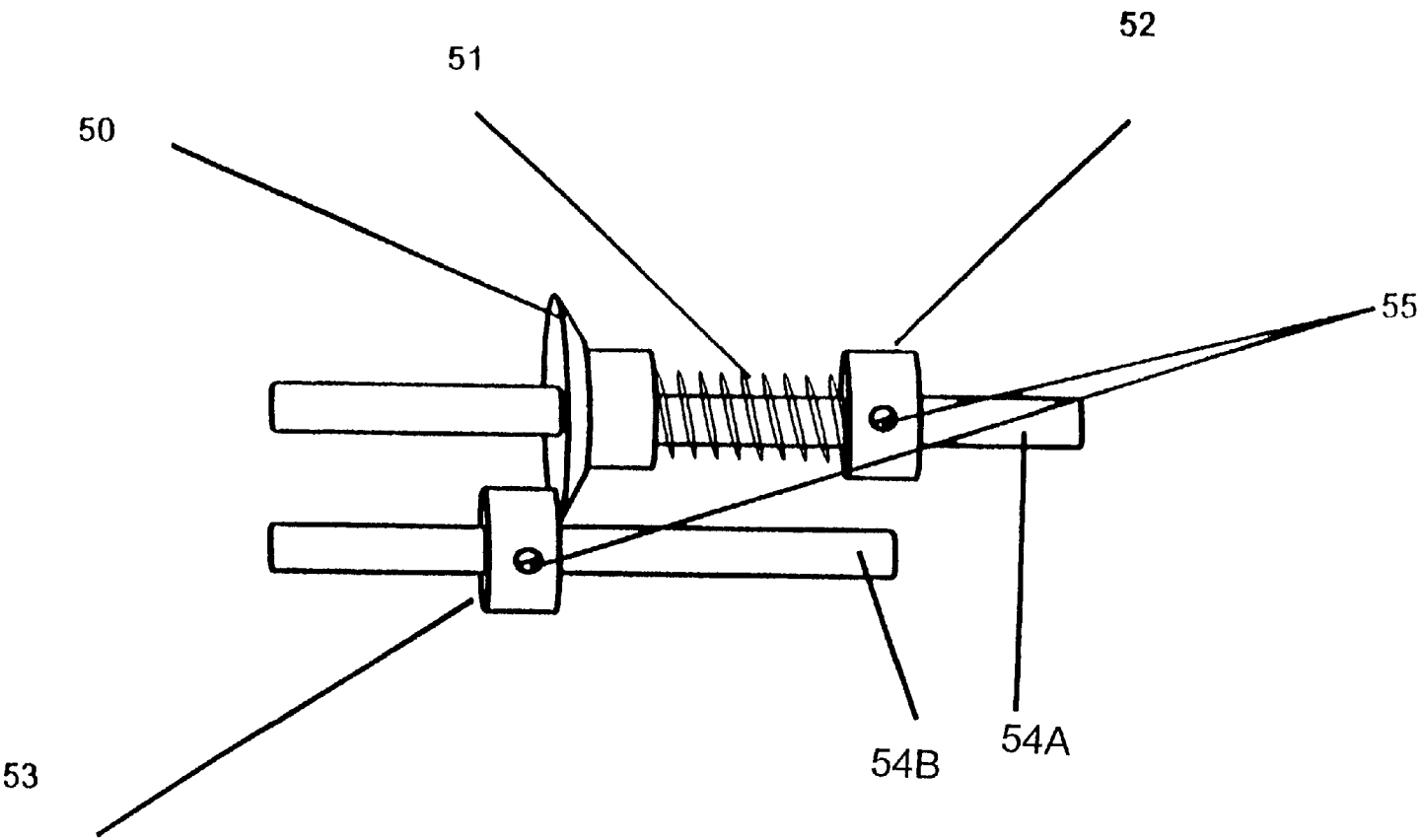
FIG. 20 illustrates a specific embodiment of a paper cutting means in accordance with the subject invention.

Referring to FIG. 20, a specific embodiment of a paper cutting means 10 for cutting paper in accordance with the subject invention is shown. Advantageously, the paper cutting means 10 shown in FIG. 20 can cut a sheet of paper without impeding the movement of the paper, and at the same time can expose the fibers of the paper to improve the adhesiveness of the glue applied to the spine of the book block. Knife 50 can be a solid piece of material or any other shape which allows proper cutting, vary in width and length, and is made of a material having sufficient hardness to cut the paper as knife 50 contacts counter-knife 53, for example hardened stainless steel. The edge of knife 50 can be sharpened at various angles, preferably between 45°–90° relative to the axis of shaft 54A, and more preferably between 60°–75° relative to the axis of shaft 54A. This shape of knife 50 can assist the movement of the paper sheet through paper cutting means 10 as it cuts.

The paper sheet is fed into paper cutting means 10 in a direction into the page of FIG. 20, or perpendicular to the plane in which shaft 54A and shaft 54B lie. Shafts 54A and 54B can rotate in different directions such that the paper sheet can be cut where knife 50 and counter-knife 53 contact. Shafts 54A and 54B can be interconnected by some sort of means for causing shaft 54A to rotate when shaft 54B is rotated, for example, by motor 61 (see FIG. 21). Alternatively, motor 61 can simultaneously rotate both shaft 54A and 54B. Counter-knife 53 can be secured to shaft 54B by, for example, set screw 55, which can allow for the adjustment of the position of counter-knife 53 along shaft 54B. Knife 50 can be secured to shaft 54A, although preferably knife 50 is free to move along the length of shaft 54A such that a tension producing device 51 can push knife 50 toward counter-knife 53 for proper cutting. In a specific embodiment, knife 50 is interconnected with shaft 54A by a means which causes knife 50 to rotate when shaft 54A rotates but allows knife 50 to slide along shaft 54A, such as a slot and groove. Preferably, the tension at which knife 50 is pushed a/g counter-knife 53 is such as to allow the paper to be cut and at the same time slightly torn. To accomplish this, knife 58 can be held against counter-knife 53 by spring 51, preferably with at least 3 kg of tension per sq in. The spring itself can be adjusted by stop 52, positioned along shaft 54A with, for example, a set screw. Counter-knife 53 is preferably made out of a material which experiences low friction when in contact with knife 50, therefore producing only a small amount of heat and erosion on both knife 50 and counter-knife53. In a specific embodiment, counter-knife53 can be made from compacted a nylon.

Figure 21:
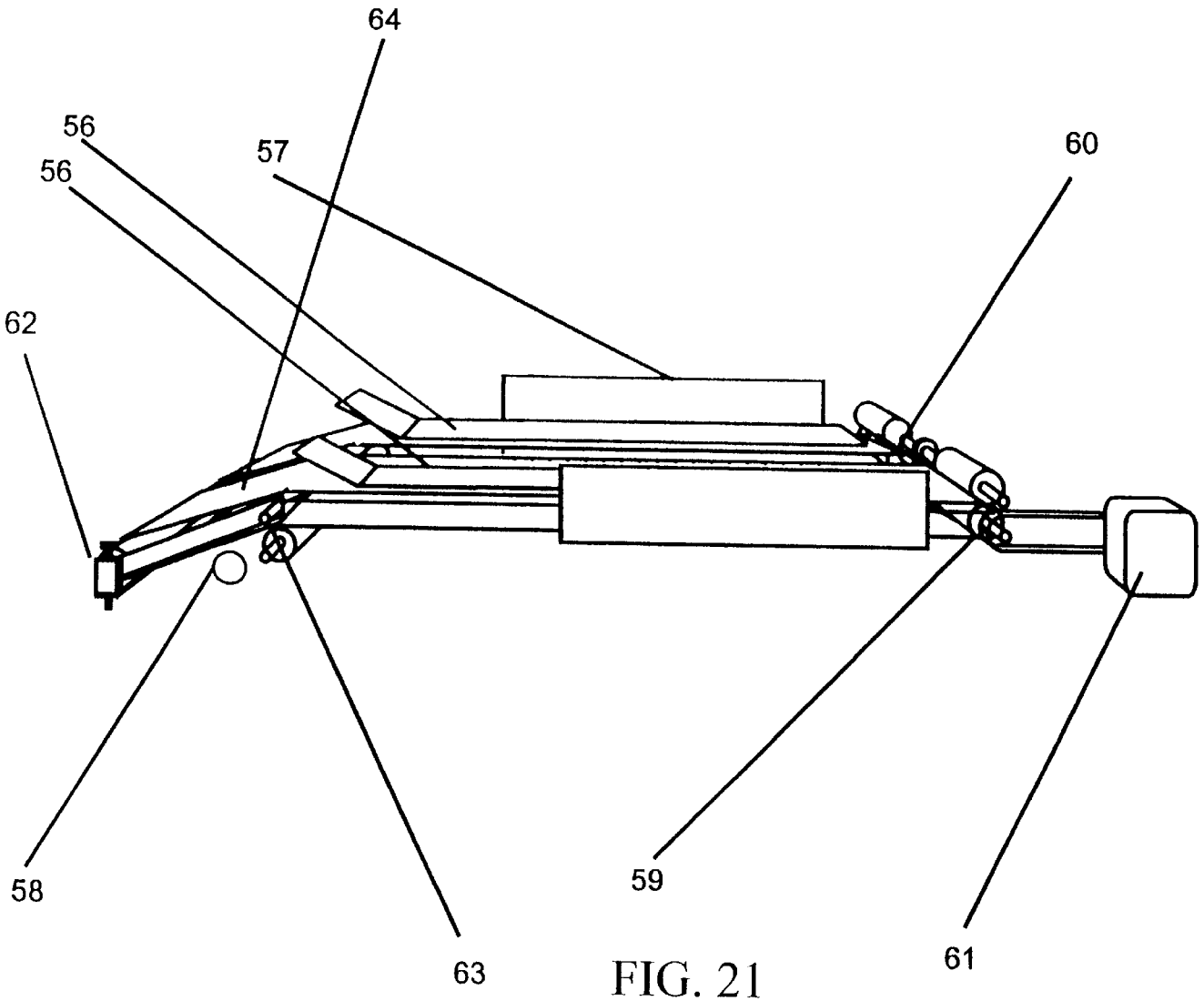
FIG. 21 illustrates a specific embodiment of a paper cutting means in accordance with the subject invention.

In order for the pages of the book to align at the edges of the book block it is preferred for all of the pages to be the same width and for the cuts to be at right angles to edges of the paper sheets. In order to accomplish this, the subject invention can align and flatten the printed paper sheets after they exit the printer. Referring to FIG. 21, a specific embodiment of this portion of the subject invention is shown. The printer paper sheets can be received from the printer near receiving end of conveyor 64 which can also incorporate a means 62 for adjusting the height of such receiving end of conveyor 64, which can also incorporate a means 62 for adjusting the height of such receiving end. Traditional means of moving the paper, such as rollers, can be used. However, in a preferred embodiment, conveyor 64 can utilize a less rigid surface, such as rubber or latex, to contact the paper. Since the paper is very light, this can assist in aligning the paper. In the embodiment shown in FIG. 2*d* conveyor 64 is formed of two strips, allowing the paper to slide and letting air contact and cool the paper. Conveyor 64 can be driven by motor 61, for example by the turning of a pulley placed on the end of the shaft 59. shaft 59 can also rotate cutting device 60. In a specific embodiment shaft 54B can be one in the same as shaft 59 and cutting device 60 can be one in the same as knife 50 and counter-knife 53.

One or more sliders 56 can be utilized on top of conveyor strips 64. Sliders 56 can be made of, for example, a light plastic and preferably should be essentially frictionless with respect tot he paper sheets. As conveyor strips 64 move the paper sheets along, sliders 56 can apply pressure to flatten the paper sheets and can also remove some of the static electricity and heat which the printed sheets of paper have upon exiting the printer, for example a laser printer. In a specific embodiment, sliders 56 can discharge the static electricity from the sheets via a grounded wire.

As a sheet of paper leaves the printer and enters the conveyor 64, a sensor 58 can be triggered. This sensor 58 can then send a signal to pushing device 57 which can then push the paper sheets against a guide on the other side of the paper sheet. The pushing of the paper sheet again the guide by pushing device 57 can position the paper relative to the cutting device 60 such that the paper sheet is cut in the proper place, for example exacting in the center, and can assist in aligning the paper sheet such that the paper sheet is cut in the proper alignment, for example parallel to the edges. Accordingly, the pushing device can help to ensure the paper sheets are cut square and properly dimensioned.

In a specific embodiment, as shown in FIG. 21, conveyor strips 64 are held by rollers mounted on shaft 63, such that the rollers can rotate freely on shaft 63. If desired, a second set of rollers on a second shaft can be utilized to provide tension for conveyor strips 64. This second shaft can also have adjustable guides to guide conveyor strips 64 in a direction perpendicular to the direction of paper travel.

Figure 22:
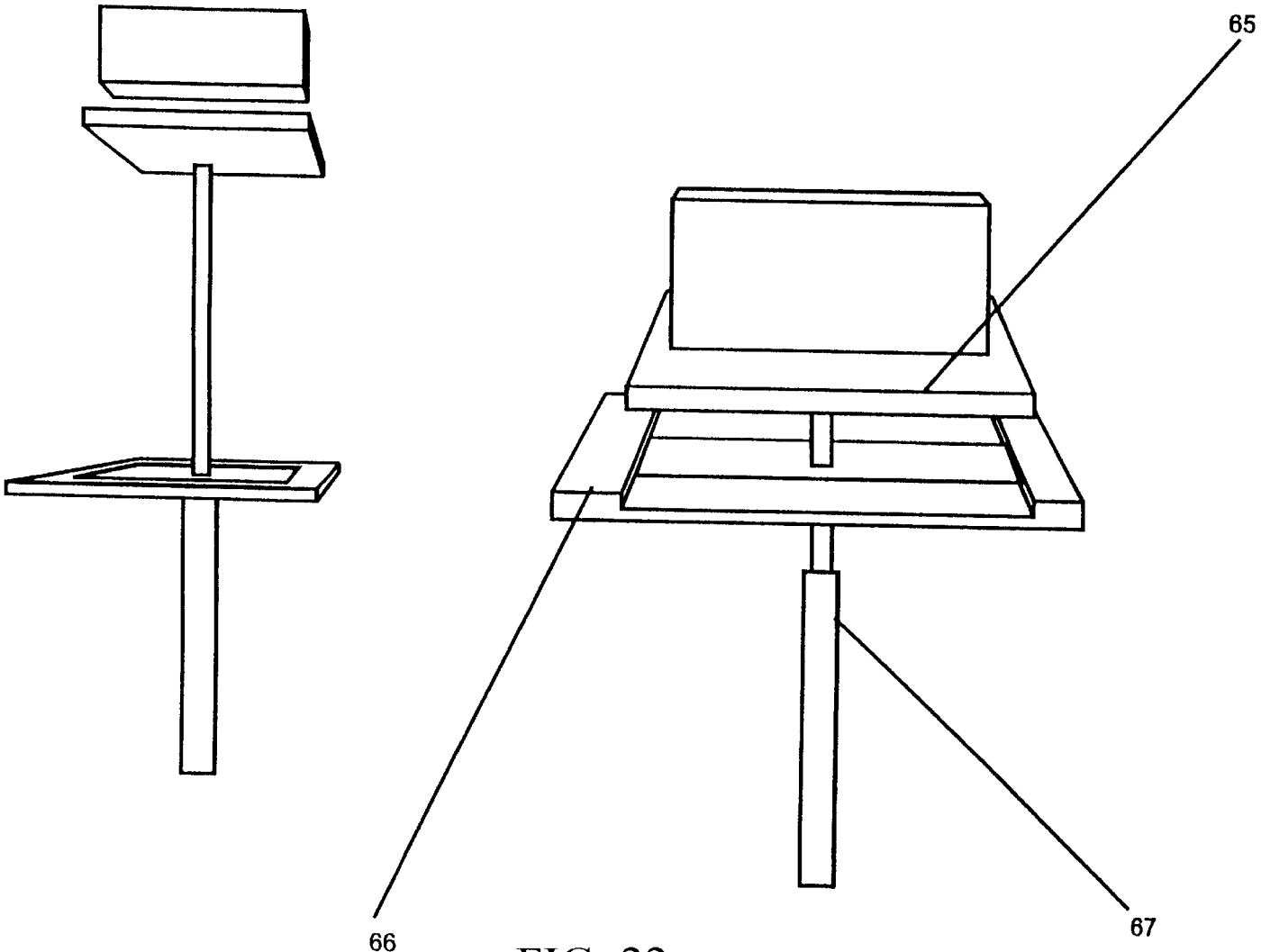
FIG. 22 illustrates a specific embodiment of a paper cutting means in accordance with the subject invention.

Traditionally, a book can have only one type of cover applied to it during the printing process. A preferred embodiment of the subject invention can allow many different types of covers to be applied to any book. Referring to FIG. 22, a cover can be placed on platform 65 and then elevated by, for example, an air cylinder 67, or other means, to a book block to which glue has already been applied. Platform 65 can be raised up from a stabilizing platform 66. Air cylinder 67 can be adjusted to press the cover to the book block using an optimal amount of pressure. This mechanism allows the use of different cover materials, and allows the binding of books in soft-cover, hardcover, fabric, leather, plastic, or other material suitable for book covers. In a specific embodiment, one or both sides of the cover can extend beyond the edge of the book block such that the cover can be bent back and used as a bookmark.

Figure 23:
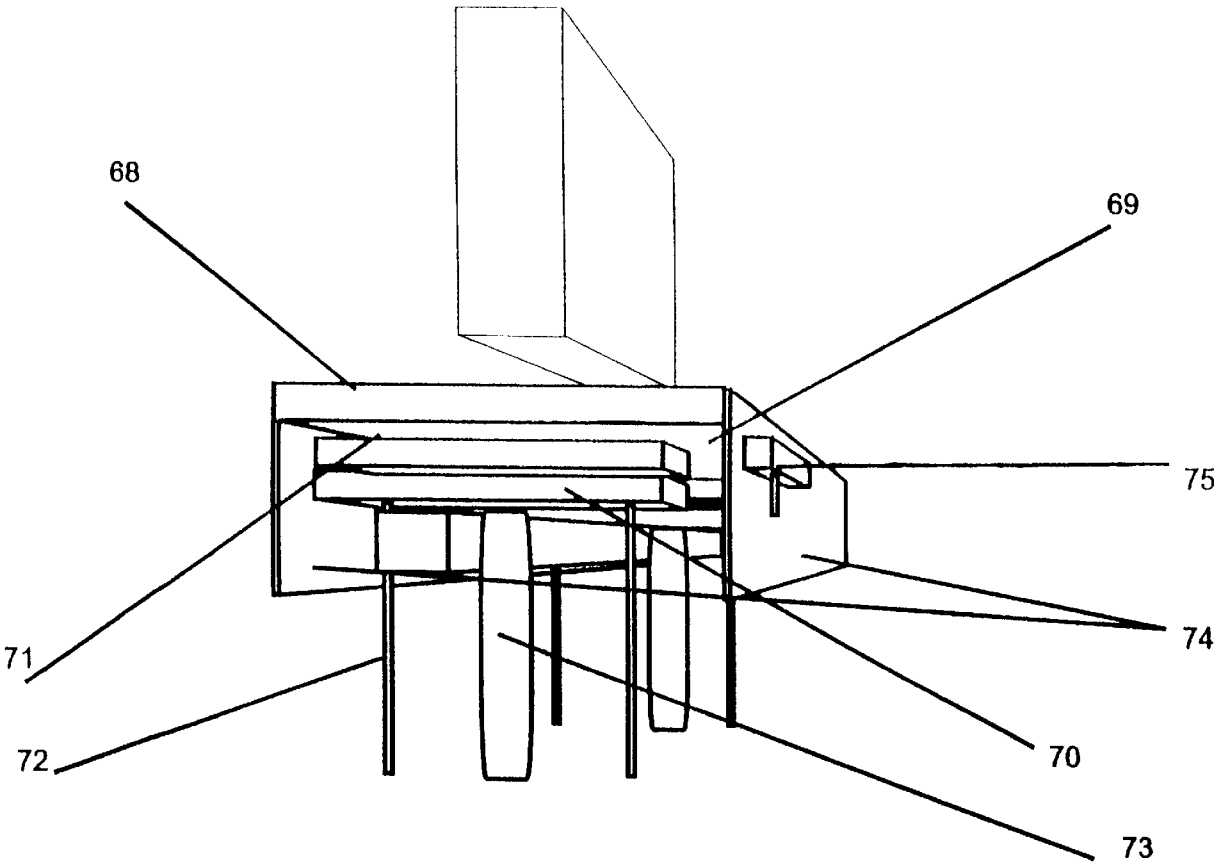
FIG. 23 illustrates a specific embodiment of a paper cutting means in accordance with the subject invention.

The application of glue to the book block can be accomplished by traditional means, such as rollers, injectors, and/or brushes. However, it can be difficult to upkeep such gluing mechanisms, some of which if it is recommended to clean after each use. A specific embodiment of the subject invention is shown in FIG. 23 for applying the glue to the book block. Glue tray 68 is designed to hold the glue, and is preferably at least about 3⁄16 of an inch deep. If hot glue is to be used, as shown in FIG. 23, a heating means 69 can be in thermal contact with glue tray 68. Heating means 69 can be in thermal contact with glue tray 68. Heating means 69 can be, for example, an electric heating element. Alternative heating mechanisms can also be used. If cold glue is used, no heating means is necessary to heat the glue prior to application of the glue, but it may be desired to heat the glue after application to speed drying. Preferably, a layer of heat sink material 70, for example aluminum, can be positioned below tray 68, and can have a protective layer 71, for example made of teflon, acting as an insulator between tray 68 and layer 70. A thermostat 75 can be used to regulate the temperature of the heating element 69 and glue tray 68. Tray 68 is at least as wide as the widest book to be bound, plus some clearage. A dispensing means can disperse the proper amount of glue into tray 68 for the book to be bound. The book block can be dipped into the glue by, for example, lowering the book block into the glue and/or raising tray 68 up to the book block. In this way the layer of glue can be controlled by, for example, how deep into the glue the book block is allowed to go. Also tray 68 allows for books of various thicknesses to have glue applied. At the present time, most commercial binders offer to bind books up to 1½ inches thick. With the subject invention books 4 inches thick or thicker can be bound. Advantageously, once the book block is dipped, the excess glue can drip back into tray 68.

Figure 24:
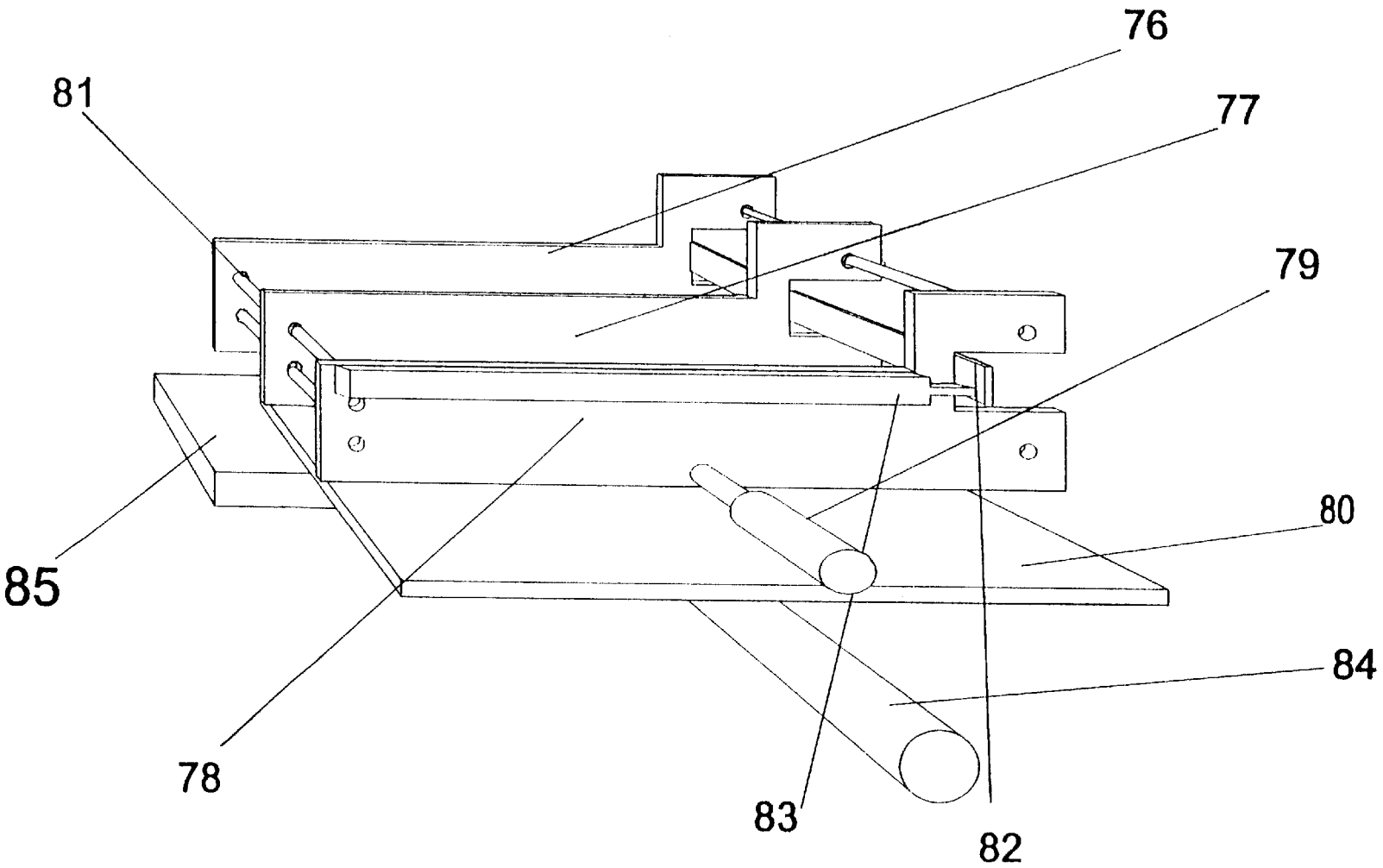
FIG. 24 illustrates a specific embodiment of a paper cutting means in accordance with the subject invention.
Figure 25:
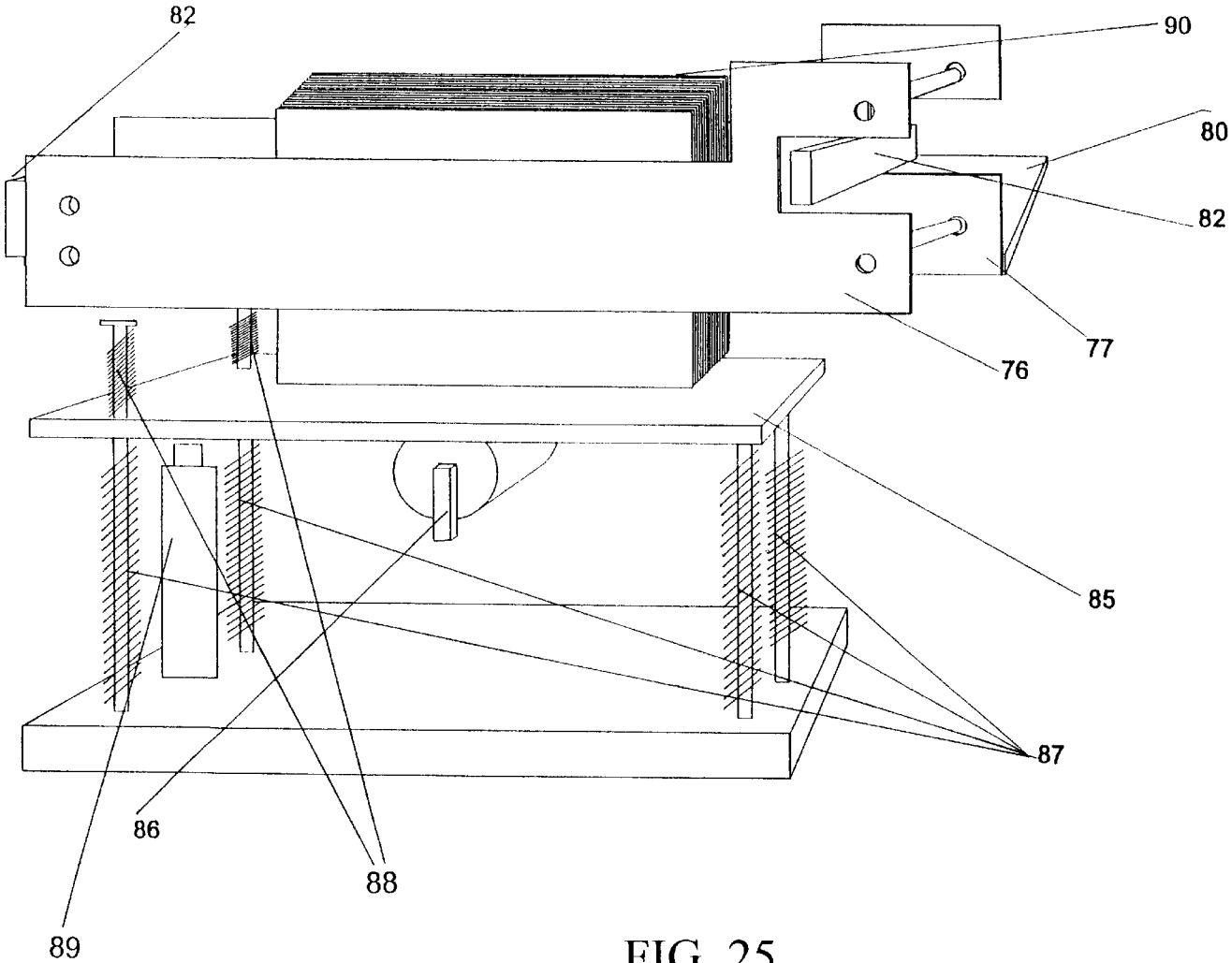
FIG. 25 illustrates a specific embodiment of a paper cutting means in accordance with the subject invention.

Referring to FIGS. 24 and 25, a specific embodiment of the subject invention for stacking and clamping paper sheets into a book block is shown. It is preferred to have the edges of the paper sheets in the book block aligned to each other. In order to accomplish this some sort of vibration of the pages and/or pushing of the edges of the paper sheets is desired. Central element 77 and movable element 76 act as a clamp to hold the paper sheets as a book block. Movable element 76 is moved toward element 77 by air cylinder 79 via shafts 81 which are connected to movable element 78 and movable element 76 and free travel through element 77 which acts as a guide. Paper sheets between elements 76 and 77 reside on top of vibrator bed 85, such when elements 76 and 77 open up the sheets are held up by vibrator bed 85.

In the embodiment shown in FIGS. 24 and 25 element 77 is fixed to platform 80. Platform 80 is designed to be rotated 180 degrees by air cylinder 84, to allow the paper sheets to be vibrated in the other direction as well. One or more oscillators 82 can be used to push on the paper sheets from the sides during vibration of the sheets to improve alignment of the sheets. In one aligning algorithm, after the proper sheets are received from the trays, movable element 76 opens and closes as the vibrator bed 85 shakes the sheets of paper and oscillator 82 simultaneously move back and forth to push the edges of the paper sheets. This can occur for a few seconds and the element 76 can clamp the book block together and turn the book block over so that the opposite edge of the paper rests on vibrator bed 85. The sequence of opening and closing element 76, vibrating vibrator bed 85, and oscillating oscillator 82 can be optimized such that the paper sheets of the book block are sufficiently aligned. Finally, element 76 clamps the book block together in order to prepare for application of the glue.

The vibration of vibrating bed 85 can be caused by the rotation of a weight placed off center on the shaft of motor 86 placed under vibrating bed 85. At periodic intervals of the paper sheets on vibrating bed 85, bed 85 can be lifted on one side, such that the paper sheets are drawn to the other end. Vibrating bed 85 can be lifted by, for example, air cylinder 89. At intermediate intervals, elements 76 and 77 can come together to clamp the paper sheets together for a second or so and then open again. Simultaneously, oscillator 82 can move the paper back and forth. This alternating movement creates a movement that can cause the individual sheets of paper 90 to align themselves into a single book block. Springs sets 87 and 88, preferably of equal tensile strength can be used to dampen the oscillations of bed 85. Springs 87 can function to keep bed 85 level, while allowing it to move. Springs 88 can counterbalance the force of the air cylinder 89 and push bed 85 back into proper position when air cylinder 89 is retracted.

Figure 26:
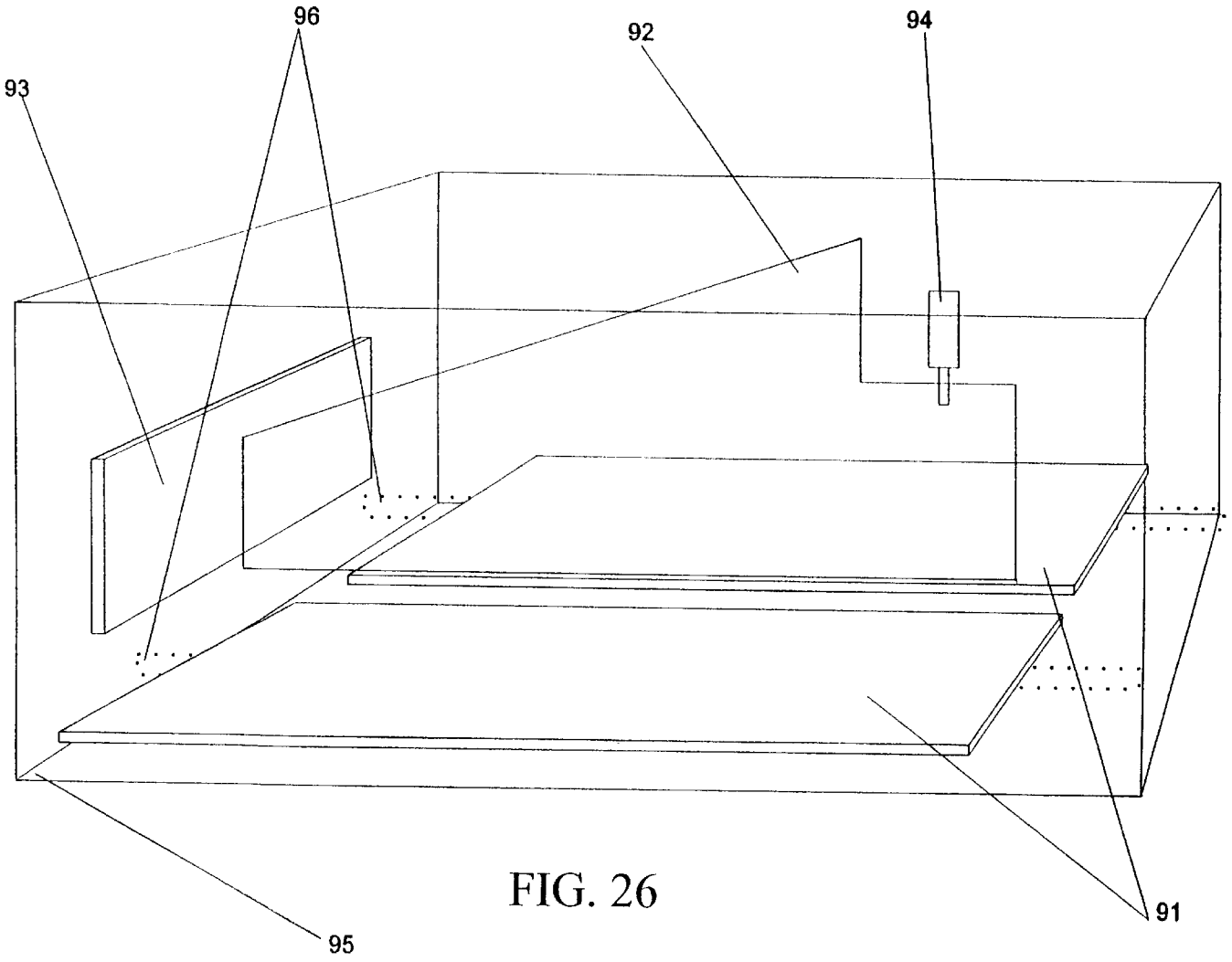
FIG. 26 illustrates a specific embodiment of a paper cutting means in accordance with the subject invention.
Figure 27:
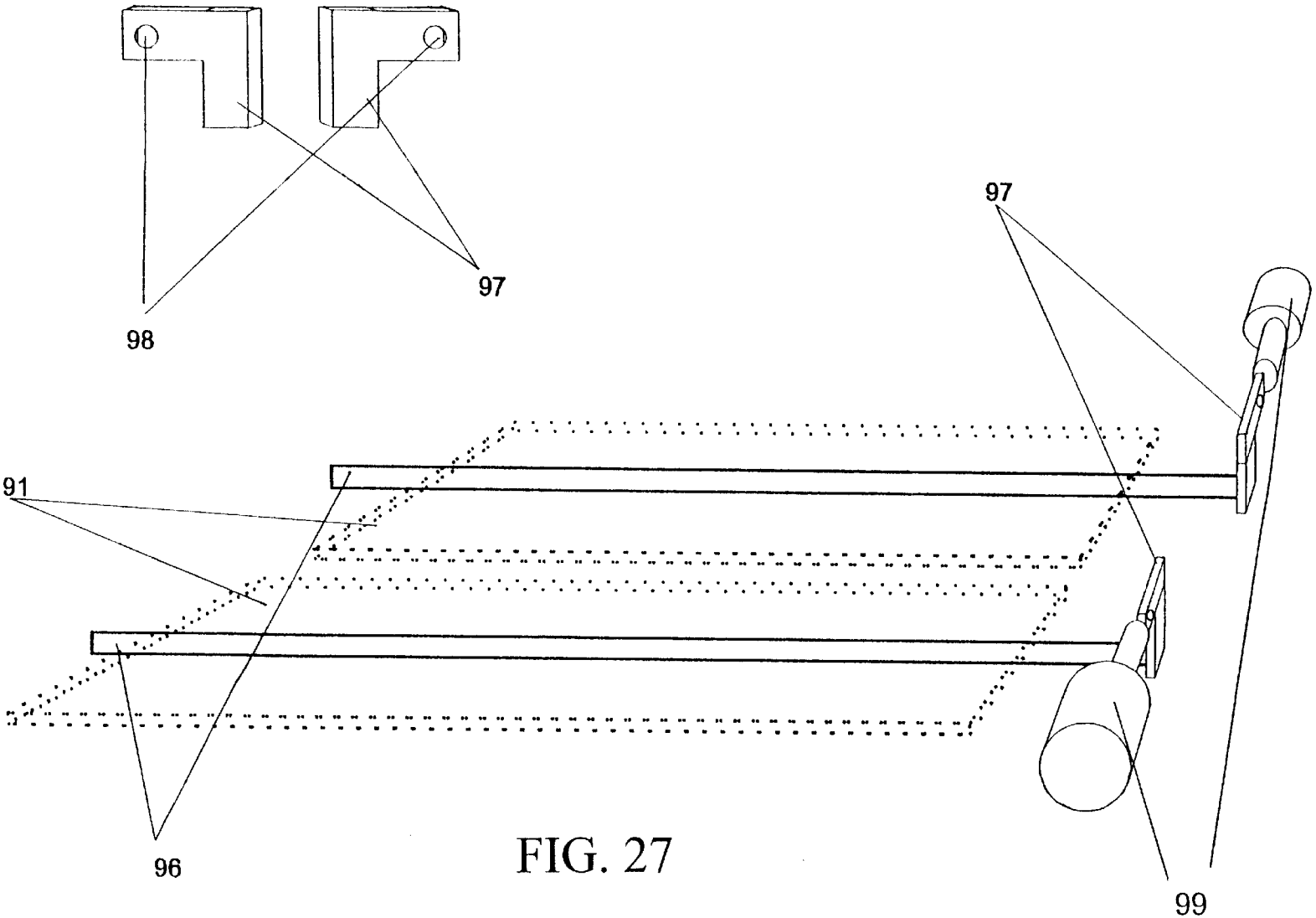
FIG. 27 illustrates a specific embodiment of a paper cutting means in accordance with the subject invention.

Referring to FIGS. 26 and 27, a specific embodiment of a paper sheet separator is shown. After passing through paper cutting means 10 the sections of cut paper fall onto paper trays 91, separated by separator 92. Housing 95 forms the sides and ends of trays 91 to keep the paper sheets square while being loaded, paper pusher 93 can be driven by an air cylinder such as to contact the sheets during the loading of the trays 91. Preferably, the paper pusher is timed with respect to the arrival of the cut sheets. Once the sheets of the book are loaded into trays 91, the stacks of sheets need to be brought together to form the book block between elements 76 and 77 of FIGS. 24 and 25. This is accomplished by rotating paper trays 91 inward and simultaneously lowering separator 92 to prevent intermingling of the paper sheets as they fall from trays 91 inward and simultaneously lowering separator 92 to prevent intermingling of the paper sheets as they fall from trays 91 to platform 85. Air cylinder 94 can drive separator 92.

FIG. 27 illustrates angle providers 97 which are used to rotate tray 91 toward separator 92 to drop the paper sheets onto platform 85.

Preferably, trays 91 are rotated 90 degrees and quickly, such that the paper sheets tend to fall together. angle providers 97, can be cut such that the desired angle of rotation is achieved. Angle providers are attached to shaft 96, connected to trays 91, at a 90 degree angle. Shafts 96 hold trays 91 horizontal until angle providers 97 is pushed a small distance on the high end 98 by an air cylinder 99, causing shafts 96 and trays 91 to rotate 90 degrees. It is preferred to have the high end 98 and the bottom end 97 the same length, and to have the distance traveled by the air cylinder also be this same length.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A system for producing and distributing books, comprising:

an input means for inputting requests for one or more books, a plurality of printing and binding means for printing and binding a book upon receipt of data corresponding to a book's content and control data, and at least one distribution unit which receives a request for a selected book and causes said data corresponding to a book's content and control data to be transferred to said printing and binding means, wherein at least one of said at least one distribution unit and at least one of said plurality of printing and binding means are geographically separated.

2. The system according to claim 1, wherein each printing and binding means for printing and binding books comprises:

a receiving means for receiving data corresponding to a book's content;

a formatting means for formatting the book's content into a book distribution;

a printing means for printing the book's content on paper sheets upon receipt of a signal from said receiving means;

a clamping means for clamping the printed sheets into a book block; and a glueing means for applying glue to a spine of the book block.

3. The system, according to claim 1, wherein said at least one distribution unit comprises a storage means wherein said distribution unit accesses the data corresponding to the selected book's content from said storage means.

4. The system, according to claim 1, wherein one said distribution unit accesses the data corresponding to the selected book's content from a plurality of storage facilities.

5. The system, according to claim 1, wherein the data corresponding to the selected book's content and control data transferred from said at least one distribution unit to the printing and data binding means includes formatting data.

6. The system according to claim 1, wherein said glueing means applies a cold glue.

7. The system according to claim 1, wherein said receiving means can receive data corresponding to the book's content from a remote location wherein said receiving means deletes said data after printing the book so as to avoid unauthorized copies of the book from being printed.

8. The system according to claim 1, wherein said data corresponding to the book's content includes control data which indicates format, font type, or type size of the book's content, wherein said formatting means controls the format, font type, or type size of the book's content in accordance with the control data.

9. The system according claim 1, wherein said device capable of printing and binding said ordered book(s) further comprises a user interaction means whereby a customer can select a book to be printed and bound.

10. The system, according to claim 4, wherein said plurality of storage facilities correspond to a plurality of publishers and authors.

11. The system according to claim 6, wherein said cold glue is water based.

12. A method for producing and distributing books, comprising the following steps:

creating a plurality of electronic text files corresponding to a plurality of books such that each electronic text file corresponds to one book's content;

storing said plurality of text files;

allowing a customer to order one or more of said plurality of books; and transmitting the electronic text files corresponding to the ordered book(s) to a device capable of printing and binding said ordered book(s), wherein said device capable of printing and binding said ordered book(s) comprises:

a receiving means for receiving data corresponding to a book's content;

a formatting means for formatting the book's content into a book distribution;

a printing means for printing the book's content on paper sheets upon receipt of a signal from said receiving means;

a clamping means for clamping the printed sheets into a book block; and a glueing means for applying glue to a spine of the book block, wherein said ordered books are printed and bound such as to allow the customer to pick-up the ordered book(s).

13. The method of claim 12 wherein the step of transmitting the electronic text file(s) corresponding to the ordered book(s) comprises transmitting the electronic text files to one or more of a plurality of devices capable of printing and binding said ordered book(s).

14. The method according to claim 12, wherein said glueing means applies a cold glue.

15. The method according to claim 12, wherein said device capable of printing and binding said ordered book(s) further comprises a user interaction means whereby a customer can select a book to be printed and bound.

16. The method of claim 13, wherein the step of storing said plurality of text files comprises storing said plurality of text files at one or more of at least one storage means, wherein at least one of said at least one storage means is geographically separated from at least one of said plurality of devices capable of printing and binding said ordered book(s).

17. The method according to claim 13, wherein said cold glue is water based.

18. The method according to claim 16, wherein after the customer orders one or more of said plurality of books, the step of transmitting the electronic text file(s) corresponding to the ordered book(s) to a device capable of printing and binding said ordered book(s) comprises transmitting the electronic text file(s) corresponding to the ordered book(s) from one or more of said at least one storage means to one or more of said plurality of devices capable of printing and binding said ordered book(s).

19. The method according to claim 16, wherein at least one of said at least one storage means is associated with a publisher.

* * * * *

UNITED STATES PATENT AND TRADEMARK OFFICE

CERTIFICATE OF CORRECTION

PATENT NO. : 6,213,703 B1
DATED : April 10, 2001
INVENTOR(S) : Victor Manuel Celorio Garrido It is certified that error appears in the above-identified patent and that said Letters Patent is hereby corrected as shown below:

Column 4,
Line 38, "illustrates final" should read -- illustrates a final --.

Column 12,
Line 13, "indistinguishablefrom" should read -- indistinguishable from --.

Column 13,
Line 25, (both instances): "counter-knife53" should read -- counter-knife 53 --.
Line 26, "compacted a nylon" should read -- compacted nylon --.

Signed and Sealed this

Twenty-sixth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,213,703 C1
APPLICATION NO. : 95/000393
DATED : May 23, 2014
INVENTOR(S) : Victor Manuel Celorio Garrido It is certified that error appears in the above-identified patent and that said Letters Patent is hereby corrected as shown below:

In the Claims

Column 2, lines 17-20, Claim 20 should read
The system according to claim 10, wherein the plurality of publishers and authors is a plurality of publishers.

Column 2, lines 21-23, Claim 21 should read
The system according to claim 20, wherein the at least one distribution unit causes said data corresponding to the book's content and control data to be transferred to said printing and binding means causes said data corresponding to the book's content and control data to be transferred to said printing and binding means directly from one of the plurality of publishers.

Signed and Sealed this
Sixth Day of January, 2015

Michelle K. Lee

Michelle K. Lee
*Deputy Director of the United States Patent and Trademark Office*

US006213703C1

(12) INTER PARTES REEXAMINATION CERTIFICATE (886th)

United States Patent

Garrido

(10) Number: US 6,213,703 C1

(45) Certificate Issued: *May 23, 2014

(54) ELECTRONIC BOOKSTORE VENDING MACHINE

(75) Inventor: Victor Manuel Celorio Garrido, Gainesville, FL (US)

(73) Assignee: Instabook Corporation, Gainesville, FL (US)

Reexamination Request:
No. 95/000,393, Nov. 11, 2008

Reexamination Certificate for:

| | |
|---|---|
| Patent No.: | **6,213,703** |
| Issued: | **Apr. 10, 2001** |
| Appl. No.: | **09/559,500** |
| Filed: | **Apr. 27, 2000** |

Certificate of Correction issued Feb. 26, 2002

( * ) Notice: This patent is subject to a terminal disclaimer.

Related U.S. Application Data

(63) Continuation-in-part of application No. 09/353,006, filed on Jul. 13, 1999, now abandoned, which is a continuation-in-part of application No. 08/943,175, filed on Oct. 3, 1997, now Pat. No. 6,012,890.

(60) Provisional application No. 60/130,993, filed on Apr. 23, 1999, provisional application No. 60/028,068, filed on Oct. 4, 1996.

(30) Foreign Application Priority Data

Sep. 29, 1998 (WO) ..... PCT/US9820421

(51) Int. Cl.
*B41F 13/54* (2006.01)
*B42C 19/00* (2006.01)

(52) U.S. Cl.
USPC ..... 412/19; 270/1.02; 270/1.03; 270/21.1; 412/4; 412/8; 412/16; 412/32

(58) Field of Classification Search
None
See application file for complete search history.

(56) References Cited

To view the complete listing of prior art documents cited during the proceeding for Reexamination Control Number 95/000,393, please refer to the USPTO's public Patent Application Information Retrieval (PAIR) system under the Display References tab.

*Primary Examiner* — Jeffrey R Jastrzab

(57) ABSTRACT

The present invention provides a method and system for producing books on-demand. An electronic bookstore in accordance with the subject invention can receive an electronic text file of a book and then print and bind a copy of the book. A user may browse an electronic catalog, for example over the Internet, and place an order for a book which can be picked up at a conveniently located electronic bookstore shortly after placing the order. The subject invention reduces costs and waste associated with conventional production and distribution of print matter. Advantageously, the subject invention allows books with smaller audiences to be published at a reasonable price. An electronic bookstore in accordance with the subject invention can have access to literally millions of books and can print and bind any selected book in a few minutes.

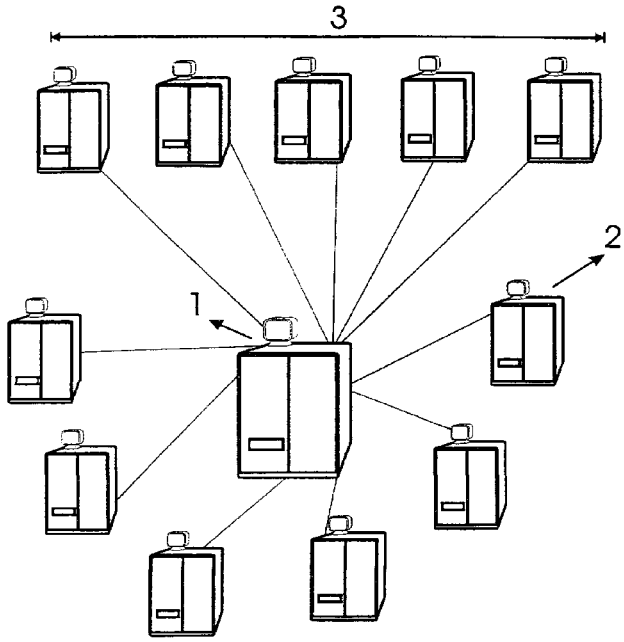

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-9 and 11-19 are cancelled.

Claim 10 is determined to be patentable as amended.

New claims 20 and 21 are added and determined to be patentable.

10. [The system, according to claim 4,] *A system for producing and distributing books, comprising:*

*an input means for inputting requests for one or more books,*

*a plurality of printing and binding means for printing and binding a book upon receipt of data corresponding to a book's content and control data, and*

*at least one distribution unit which receives a request for a selected book and causes said data corresponding to a book's content and control data to be transferred to said printing and binding means, wherein at least one of said at least one distribution unit and at least one of said plurality of printing and binding means are geographically separated;*

*wherein said at least one distribution unit accesses the data corresponding to the selected book's content from a plurality of storage facilities; and* wherein said plurality of storage facilities correspond to a plurality of publishers and authors.

*20. The system according to claim 1, wherein at least one of the printing and binding means automatically prints and binds a book upon receipt of data corresponding to a book's content.*

*21. The system according to claim 1, wherein the data corresponding to a book's content comprises an electronic text file.*

* * * * *